US009108821B2

(12) United States Patent
Nakada et al.

(10) Patent No.: US 9,108,821 B2
(45) Date of Patent: Aug. 18, 2015

(54) SHEET FOLDING APPARATUS, IMAGE FORMING APPARATUS, AND IMAGE FORMING SYSTEM

(71) Applicants: Kyosuke Nakada, Kanagawa (JP); Tomohiro Furuhashi, Kanagawa (JP); Shuuya Nagasako, Kanagawa (JP); Kazuya Yamamoto, Kanagawa (JP); Yuji Suzuki, Kanagawa (JP); Takahiro Watanabe, Kanagawa (JP); Michitaka Suzuki, Kanagawa (JP); Akira Kunieda, Tokyo (JP); Kiichiro Goto, Kanagawa (JP)

(72) Inventors: Kyosuke Nakada, Kanagawa (JP); Tomohiro Furuhashi, Kanagawa (JP); Shuuya Nagasako, Kanagawa (JP); Kazuya Yamamoto, Kanagawa (JP); Yuji Suzuki, Kanagawa (JP); Takahiro Watanabe, Kanagawa (JP); Michitaka Suzuki, Kanagawa (JP); Akira Kunieda, Tokyo (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/102,951

(22) Filed: Dec. 11, 2013

(65) Prior Publication Data

US 2014/0179504 A1 Jun. 26, 2014

(30) Foreign Application Priority Data

Dec. 20, 2012 (JP) ..... 2012-278358

(51) Int. Cl.

| | |
|---|---|
| ***B65H 45/20*** | (2006.01) |
| ***B65H 45/12*** | (2006.01) |
| ***B65H 45/14*** | (2006.01) |
| ***B31F 1/00*** | (2006.01) |
| ***B31F 1/10*** | (2006.01) |

(52) U.S. Cl.

CPC ..... *B65H 45/12* (2013.01); *B31F 1/0025* (2013.01); *B31F 1/10* (2013.01); *B65H 45/147* (2013.01); *B65H 45/20* (2013.01); *B65H 2801/27* (2013.01)

(58) Field of Classification Search

CPC ..... B31F 1/10; B31F 1/0025; B65H 45/20; B65H 45/147

USPC ..... 270/32, 39.01; 493/416, 419, 434, 435, 493/421, 440, 442

See application file for complete search history.

(56) References Cited

U.S. PATENT DOCUMENTS

| | | | | |
|---|---|---|---|---|
| 6,592,506 | B1 * | 7/2003 | Lyga | 493/424 |
| 6,719,680 | B2 * | 4/2004 | Hosoya et al. | 493/324 |
| 7,658,372 | B2 * | 2/2010 | Kubo | 270/37 |
| 2007/0176357 | A1 | 8/2007 | Horio et al. | |
| 2007/0238596 | A1 | 10/2007 | Terhaag et al. | |

(Continued)

FOREIGN PATENT DOCUMENTS

| | | |
|---|---|---|
| JP | 2006-052074 | 2/2006 |
| JP | 2007-277006 | 10/2007 |

*Primary Examiner* — Leslie A Nicholson, III

(74) *Attorney, Agent, or Firm* — Harness, Dickey & Pierce, P.L.C.

(57) ABSTRACT

A sheet folding apparatus includes: a first sheet conveying unit; a second sheet conveying unit that is disposed downstream of the first sheet conveying unit; a folded part forming unit that forms a folded part on a sheet by nipping a turned-back portion formed on a part of the sheet between the first sheet conveying unit and the second sheet conveying unit; a second conveying path that bifurcates from the first conveying path and in which a sheet with the folded part is conveyed; and a pushing member that is movable between a pushing position at which the pushing member pushes the turned-back portion toward the folded part forming unit and a retracted position. The pushing member also serves as a changing unit that changes a direction of a leading end of the sheet that is conveyed in the first conveying path into a direction toward a second conveying path.

8 Claims, 12 Drawing Sheets

(56) References Cited

U.S. PATENT DOCUMENTS

| | | | | |
|---|---|---|---|---|
| 2008/0001338 | A1* | 1/2008 | Kotani | 270/37 |
| 2009/0062100 | A1 | 3/2009 | Takekawa et al. | |
| 2009/0129840 | A1 | 5/2009 | Takekawa et al. | |
| 2010/0252981 | A1 | 10/2010 | Kimata et al. | |
| 2011/0190109 | A1 | 8/2011 | Kimata | |
| 2011/0221125 | A1 | 9/2011 | Kimata | |
| 2012/0071310 | A1* | 3/2012 | Satoh | 493/442 |

* cited by examiner

SHEET FOLDING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2012-278358 filed in Japan on Dec. 20, 2012.

BACKGROUND OF THE INVENTION

1. Field of the Invention

The present invention relates to a sheet folding apparatus that performs folding processing on a sheet, an image forming apparatus equipped with the sheet folding apparatus, and an image forming system.

2. Description of the Related Art

A conventional image forming system is known that is equipped with a sheet folding apparatus that performs folding processing on a sheet on which an image is formed by an image forming apparatus. A sheet folding apparatus is known that performs folding processing in which a bend formed on a sheet in a conveying path is nipped and conveyed between a pair of folding rollers that is a pair of roller members to form a folded part.

A sheet folding apparatus described in Japanese Patent Application Laid-open No. 2007-277006 includes a pair of upstream rollers and a pair of downstream rollers that are disposed along a sheet conveying direction and that hold a part of a sheet to apply conveying force to the sheet. The sheet folding apparatus also includes a pair of folding rollers that forms a folded part on the sheet by nipping a turned-back portion formed between the pair of upstream rollers and the pair of downstream rollers by bending the sheet. The following describes how the sheet folding processing is performed. The pair of upstream rollers and the pair of downstream rollers each hold a part of the sheet, and the pair of downstream rollers applies conveying force to the sheet to reverse the sheet upstream in the sheet conveying direction, thereby forming a turned-back portion on the sheet between the pair of upstream rollers and the pair of downstream rollers. The turned-back portion thus formed is then guided to and nipped between the pair of folding rollers to form a folded part on the sheet.

When a stiff sheet such as thick paper is used, for example, poor folding may occur because the turned-back portion formed by reversing the pair of downstream rollers cannot be nipped between the pair of folding rollers depending on the thickness or the type of the sheet.

A sheet folding apparatus described in Japanese Patent Application Laid-open No. 2006-52074 includes a pushing member that is movable between a pushing position at which the pushing member pushes a turned-back portion of a sheet in the thickness direction of the sheet toward a nip between the pair of folding rollers, and a retracted position at which the pushing member is retracted from the pushing position.

The pushing member moved from the retracted position to the pushing position pushes the turned-back portion into the pair of folding rollers, so that the turned-back portion is surely guided into the nip between the pair of folding rollers. Providing such a pushing member enables appropriate folding processing.

A sheet folding apparatus, for example, can be smaller in size when it is not provided with a conveying path dedicated for folding processing inside the apparatus. This is possible when the sheet folding apparatus is provided with a pair of folding rollers in a conveying path that conveys a sheet to an apparatus such as a sheet post-processing apparatus disposed downstream of the sheet folding apparatus. With this configuration, when the pair of folding rollers does not form a folded part, the sheet folding apparatus switches a direction in which the leading end of the sheet proceeds by a bifurcating claw, or the like, from a direction from the pair of upstream rollers to the pair of downstream rollers to a direction from the pair of upstream rollers to the pair of folding rollers. The sheet folding apparatus then needs to change the course of the sheet so that the leading end of the sheet proceeds from the pair of upper rollers through the pair of folding rollers to a conveying path disposed downstream of the pair of folding rollers.

Providing both the pressing member and the bifurcating claw in the sheet folding apparatus to guide the turned-back portion toward the pair of folding rollers or to change the course of the sheet increases the number of parts and requires additional installation space for the members, thereby undesirably increasing the size of the apparatus.

In view of the above, there is a need to provide a sheet folding apparatus that can guide a turned-back portion of a sheet toward a folded part forming unit, and can change the course of the sheet by changing the direction of the leading end of the sheet without increasing the size of the apparatus, an image forming apparatus equipped with the sheet folding apparatus, and an image forming system.

SUMMARY OF THE INVENTION

It is an object of the present invention to at least partially solve the problems in the conventional technology.

A sheet folding apparatus includes: a first conveying path in which a sheet is conveyed; a first sheet conveying unit that holds the sheet conveyed in the first conveying path to apply conveying force to the sheet; a second sheet conveying unit that is disposed downstream of the first sheet conveying unit in a sheet conveying direction, and holds the sheet to apply conveying force to the sheet; a folded part forming unit that forms a folded part on a sheet by nipping a turned-back portion formed on a part of the sheet between the first sheet conveying unit and the second sheet conveying unit; a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position. The pushing member also serves as a changing unit that changes a direction of a leading end of the sheet that is conveyed in the first conveying path from the first sheet conveying unit toward the second sheet conveying unit into a direction toward the second conveying path.

An image forming apparatus includes: an image forming unit that forms an image on a sheet; and a sheet folding unit that is provided in an apparatus body of the image forming apparatus and that performs folding processing on a sheet. The sheet folding unit includes: a first conveying path in which a sheet is conveyed; a first sheet conveying unit that holds the sheet conveyed in the first conveying path to apply conveying force to the sheet; a second sheet conveying unit that is disposed downstream of the first sheet conveying unit in a sheet conveying direction, and holds the sheet to apply conveying force to the sheet; a folded part forming unit that forms a folded part on a sheet by nipping a turned-back portion formed on a part of the sheet between the first sheet conveying unit and the second sheet conveying unit; a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position. The pushing member also serves as a changing unit that changes a direction of a leading end of the sheet that is conveyed in the first conveying path from the first sheet conveying unit toward the second sheet conveying unit into a direction toward the second conveying path.

An image forming system includes: an image forming apparatus that forms an image on a sheet; and a sheet folding apparatus that is provided separately from the image forming apparatus and that performs folding processing on a sheet on which an image is formed by the image forming apparatus. The sheet folding apparatus includes: a first conveying path in which a sheet is conveyed; a first sheet conveying unit that holds the sheet conveyed in the first conveying path to apply conveying force to the sheet; a second sheet conveying unit that is disposed downstream of the first sheet conveying unit in a sheet conveying direction, and holds the sheet to apply conveying force to the sheet; a folded part forming unit that forms a folded part on a sheet by nipping a turned-back portion formed on a part of the sheet between the first sheet conveying unit and the second sheet conveying unit; a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position. The pushing member also serves as a changing unit that changes a direction of a leading end of the sheet that is conveyed in the first conveying path from the first sheet conveying unit toward the second sheet conveying unit into a direction toward the second conveying path.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 9A to 95 are diagrams for explaining the operation of a guide member to guide a surface of a sheet to a folding unit;

FIGS. 11A to 115 are explanatory diagrams for explaining the general procedure of z-shaped folding processing performed by the folding processing apparatus;

DETAILED DESCRIPTION OF THE PREFERRED EMBODIMENTS

The following describes an embodiment in which a folding processing apparatus as a sheet conveying apparatus according to the present invention is applied to an image forming system.

Figure 2:
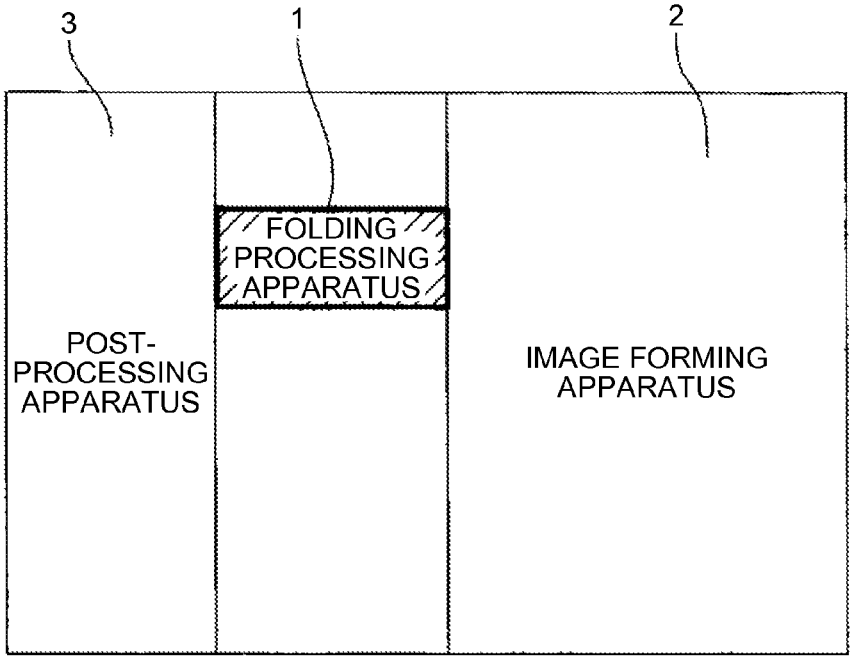
FIG. 2 is an explanatory diagram for explaining an example of an image forming system equipped with a folding processing apparatus according to the present embodiment.

FIG. 2 is an explanatory diagram for explaining an example of an image forming system equipped with a folding processing apparatus according to the present embodiment.

A folding processing apparatus 1 of this example is one of sheet post-processing apparatuses that perform post processing on a sheet ejected from an image forming apparatus 2. The image forming system of this example includes a sheet post-processing apparatus 3 that performs post processing on a sheet on which a folded part is formed by the folding processing apparatus 1, or on a sheet on which a folded part is not formed by the folding processing apparatus 1. The sheet post-processing apparatus 3 is, for example, a punching apparatus that punches a hole in a sheet, a sheet stitching apparatus that stitches a bundle of sheets by, for example, a stapler, or a sorting discharging apparatus that sorts sheets on which an image has been formed and discharges them to a plurality of discharge trays.

Figure 3:
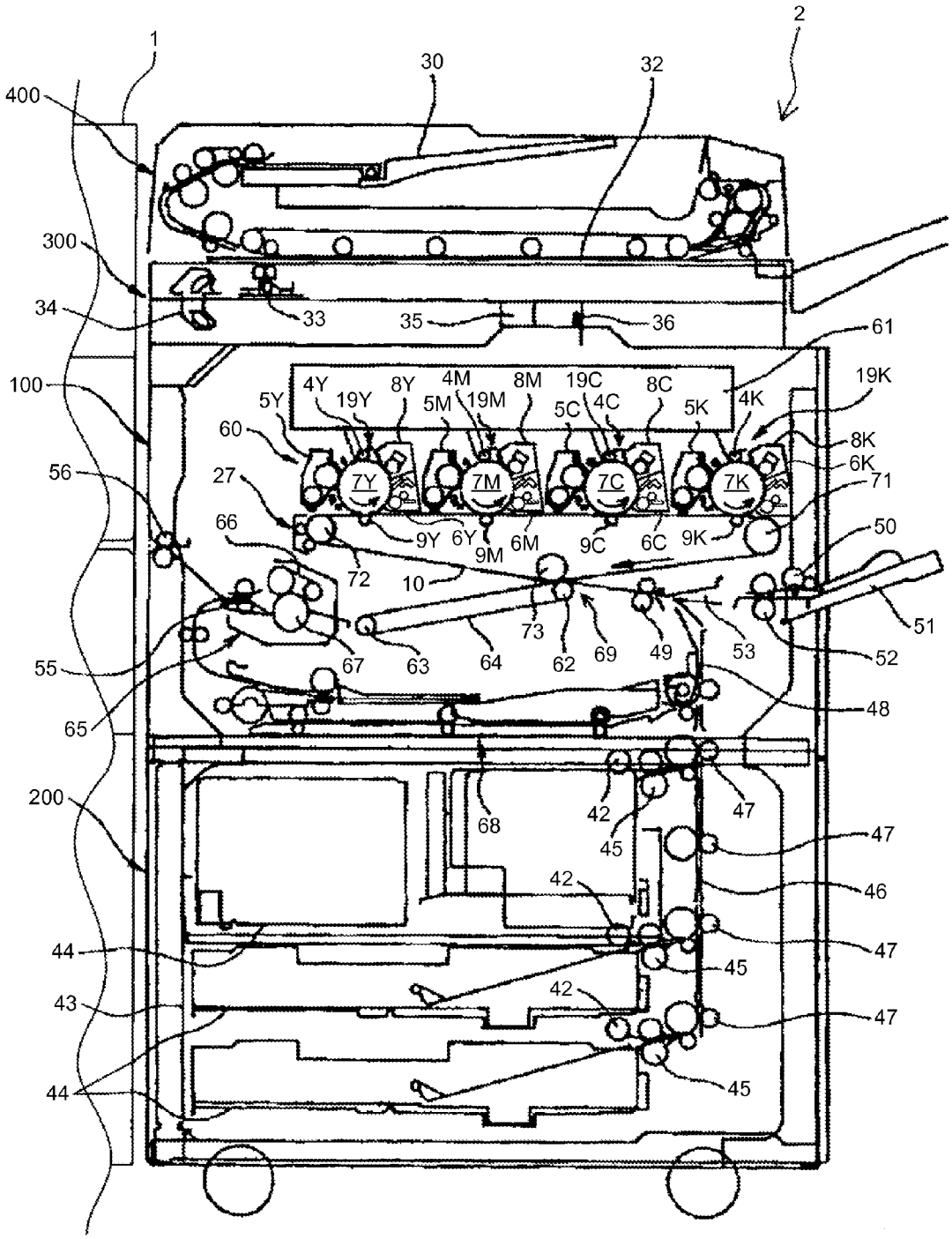
FIG. 3 is a schematic configuration diagram of an image forming apparatus equipped for the image forming system according to the embodiment.

FIG. 3 is a schematic configuration diagram of the image forming apparatus 2 equipped for the image forming system according to the embodiment. The image forming apparatus 2 includes a printer unit 100 that is an apparatus body, a feeding unit 200 that includes feed tables, a scanning unit 300 installed on the top of the printer unit 100, and a document conveying unit 400 that is an automatic document feeder (ADF) installed on the top of the scanning unit 300. The image forming apparatus 2 also includes a controller (not illustrated) that controls the operation of each unit in the image forming apparatus 2.

The printer unit 100 includes an intermediate transfer belt 10 as an intermediate transfer member disposed in the middle of the printer unit 100. The intermediate transfer belt 10 is looped over a first supporting roller 71, a second supporting roller 72, and a third supporting roller 73, and a surface of the intermediate transfer belt 10 is movable clockwise. The printer unit 100 also includes four photosensitive element drums 7Y, 7M, 7C, and 7K as latent image carriers that carry toner images having colors of yellow (Y), magenta (M), cyan (C), and black (K), respectively, on the surface. The four photosensitive element drums 7Y, 7M, 7C, and 7K are disposed opposite to the intermediate transfer belt 10.

The printer unit 100 includes charging devices 4Y, 4M, 4C, and 4K as charging units that uniformly charge the surface of the photosensitive element drums 7Y, 7M, 7C, and 7K, and developing devices 5Y, 5M, 5C, and 5K as developing units to form toner images. The charging devices 4Y, 4M, 4C, and 4K and the developing devices 5Y, 5M, 5C, and 5K are disposed around the respective photosensitive element drums 7Y, 7M, 7C, and 7K. The printer unit 100 also includes cleaning devices 6Y, 6M, 6C, and 6K that remove residual toner remaining on the surface of the photosensitive element drums 7Y, 7M, 7C, and 7K after primary transfer, and lubricant applying devices 8Y, 8M, 8C, and 8K that apply lubricant to the surface of the photosensitive element drums.

The photosensitive element drums 7Y, 7M, 7C, and 7K, the developing devices 5Y, 5M, 5C, and 5K, the charging devices 4Y, 4M, 4C, and 4K, and the cleaning devices 6Y, 6M, 6C, and 6K constitute image forming devices 19Y, 19M, 19C, and 19K, respectively, as toner image forming units. The four image forming devices 19Y, 19M, 19C, and 19K are disposed laterally to constitute a tandem image forming unit 60.

The printer unit 100 includes a belt cleaning device 27 that removes residual toner remaining on the intermediate transfer belt 10 after transferring a toner image to a sheet P as a recording member. The belt cleaning device 27 is disposed opposite to the third supporting roller 73 across the intermediate transfer belt 10. The printer unit 100 also includes an exposing device 61 above the tandem image forming unit 60.

The printer unit 100 includes primary transfer rollers 9Y, 9M, 9C and 9K inside the intermediate transfer belt 10. The primary transfer rollers 9Y, 9M, 9C and 9K are disposed opposite to the photosensitive element drums 7Y, 7M, 7C, and 7K, respectively, across the intermediate transfer belt 10 in a manner in which the primary transfer rollers 9Y, 9M, 9C and 9K press the photosensitive element drums 7Y, 7M, 7C, and 7K, respectively, to form a primary transfer unit.

The printer unit 100 includes a secondary transfer device 69 disposed opposite to the tandem image forming unit 60 across the intermediate transfer belt 10. The secondary transfer device 69 is constituted of a secondary transfer roller 62, a secondary transfer belt tension roller 63, and a secondary transfer belt 64 that is looped over the secondary transfer roller 62 and the secondary transfer belt tension roller 63. In the secondary transfer device 69, the secondary transfer belt 64 is pressed to the third supporting roller 73 through the intermediate transfer belt 10 in a position in which the secondary transfer roller 62 supports the secondary transfer belt 64. The secondary transfer device 69 is disposed such that the secondary transfer belt 64 and the intermediate transfer belt 10 form a secondary transfer nip unit as a secondary transfer unit therebetween.

The printer unit 100 includes a fixing device 65 disposed on the left side of the secondary transfer device 69 in FIG. 3. The fixing device 65 fixes a transferred image on the sheet P. The fixing device 65 includes a fixing belt 66 that is an endless belt and a pressing roller 67 disposed such that it pushes the fixing belt 66. The secondary transfer device described above also has a sheet conveying function of conveying the sheet P on which the toner image is transferred at the secondary transfer nip unit to the fixing device 65. As a secondary transfer device, a transfer roller or a contactless charger may be disposed, but it will be difficult for such a secondary transfer device to have the sheet conveying function as well.

The printer unit 100 includes a sheet reversing device 68 disposed below the secondary transfer device and the fixing device 65 and disposed parallel to the tandem image forming unit 60. The sheet reversing device 68 reverses the sheet P to record images on both surfaces thereof. After an image is fixed on one surface of the sheet P, a switching claw switches a direction in which the sheet P is conveyed to the direction of the sheet reversing device. The sheet P is reversed at the sheet reversing device 68 and conveyed again to the secondary transfer nip unit. After a toner image is transferred on the other surface of the sheet P, the sheet P can be ejected to the folding processing apparatus 1.

The scanning unit 300 scans image information on a document placed on an exposure glass 32 with a scanning sensor 36, and transfers the image information thus scanned to the controller of the image forming apparatus 2.

This controller (not illustrated) controls a light source (not illustrated) such as a laser or a light-emitting diode (LED) disposed in the exposing device 61 of the printer unit 100 to irradiate the photosensitive element drums 7Y, 7M, 7C, and 7K with laser writing light L on the basis of the image information received from the scanning unit 300. With the irradiation, an electrostatic latent image is formed on each surface of the photosensitive element drums 7Y, 7M, 7C, and 7K, and then, each latent image is developed into a toner image after a predetermined developing process.

The feeding unit 200 includes a plurality of feeding cassettes 44 stacked in a paper bank 43, feeding rollers 42 that draw sheets P from the feeding cassettes, separating rollers 45 that separate the sheets P thus drawn and send out to a feed path 46, and conveying rollers 47 to convey a sheet P to a feed path 48.

Because manual feed is also available in the image forming apparatus 2 according to the present embodiment, the image forming apparatus 2 also includes, other than the feeding unit 200, a bypass tray 51 for manual feed, and a separating roller 52 that separates sheets P on the bypass tray 51 one by one for a bypass feed path 53. The bypass tray 51 and the separating roller 52 are disposed on one side of the image forming apparatus 2.

A registration roller 49 ejects one sheet of the sheets P stored in the feeding cassettes 44 or placed on the bypass tray 51, and sends the sheet to the secondary transfer nip unit formed between the intermediate transfer belt 10 as the intermediate transfer unit, and the secondary transfer device.

To make a copy of a color image with the image forming apparatus 2 according to the embodiment, a document is set on a document table 30 in the document conveying unit 400. Alternatively, the document conveying unit 400 is first opened so as to set a document on an exposure glass 32 in the scanning unit 300 and the document conveying unit 400 is then closed so as to retain the document.

When a document is set in the document conveying unit 400, the document is first conveyed to the top of the exposure glass 32 by pressing a start button (not illustrated), and then the scanning unit 300 is driven to run a first travelling unit 33 and a second travelling unit 34. When the document is set on the exposure glass 32, the scanning unit 300 is driven immediately after pressing the start button (not illustrated) to run the first travelling unit 33 and the second travelling unit. The first travelling unit 33 emits light from a light source to a document surface. The first travelling unit 33 reflects light that has been reflected on the document surface, and the light travels to the second travelling unit 34. The light is reflected on a mirror of the second travelling unit 34, and then passes through an imaging lens 35 to enter the scanning sensor 36, which scans image information of the document.

The charging devices 4Y, 4M, 4C, and 4K uniformly charge the surface of the photosensitive element drums 7Y, 7M, 7C, and 7K. After color separation is performed on the image information scanned at the scanning unit 300, the exposing device 61 performs laser writing of the image information in each color on the photosensitive element drums 7Y, 7M, 7C, and 7K. Electrostatic latent images are thus formed on the surface of the respective photosensitive element drums 7Y, 7M, 7C, and 7K.

Described as an example is an image forming process for Y (yellow). An electrostatic latent image formed on the surface of the photosensitive element drum 7C is developed by the developing device 5Y that applies Y toner to the latent image, so that a single color toner image is formed. In the same manner, the image forming devices 19M, 19C, and 19K form single-color toner images for K (magenta), C (cyan) and K (black) in this order on the photosensitive element drums 7M, 7C, and 7K, respectively. In this image forming process, toner images are formed on the respective photosensitive element drums 7Y, 7M, 7C, and 7K, and one roller of the four feeding rollers is driven to convey a sheet P having a size of being suitable for the image information.

At the same time, one roller of the first supporting roller 71, the second supporting roller 72 and the third supporting roller 73 is rotationally driven by a driving motor (not illustrated), and the other two rollers perform idle rotation, whereby the intermediate transfer belt 10 is rotationally conveyed. While the intermediate transfer belt 10 is conveyed, the single color toner images on the respective photosensitive element drums 7Y, 7M, 7C, and 7K are sequentially transferred on the intermediate transfer belt 10, thereby forming a superimposed color image thereon.

In the feeding unit 200, one roller of the feeding rollers 42 is selected to rotate, so that the feeding roller 42 draws sheets P from one of the feeding cassettes 44. The sheets P are separated into a sheet P by a separating roller 45 and the sheet P is fed to the feed path 46. The sheet P is then guided to the feed path 48 by the conveying rollers 47, and abuts to the registration roller 49 to stop.

Otherwise, sheets P on the bypass tray 51 are drawn by rotation of a feeding roller 50, and are separated into a sheet P by the separating roller 52. The sheet P is fed into the bypass feed path 53, and abuts to the registration roller 49 to stop.

When sheets P on the bypass tray 51 are used, the sheets P on the bypass tray 51 are drawn by rotation of a feeding roller 50, and are separated into a sheet P by the separating roller 52. The sheet P is fed into the bypass feed path 53, and abuts to the registration roller 49 to stop.

The registration roller 49 rotates in synchronization with a timing at which the superimposed color image is conveyed on the intermediate transfer belt 10, and feeds the sheet P to the secondary transfer nip unit at which the intermediate transfer belt 10 and the secondary transfer roller 62 contact with each other. The superimposed color image is secondary transferred from the surface of the intermediate transfer belt 10 onto the sheet P by effects of a transfer electric field and a contact pressure formed on the secondary transfer nip, so that the sheet P records the color image thereon.

After the transfer of the color image on the sheet P at the secondary transfer nip unit, the sheet P is fed to the fixing device 65 by the secondary transfer belt 64 of the secondary transfer device 69. At the fixing device 65, the pressing roller 67 and the fixing belt apply pressure and heat to the sheet P, thereby fixing the color image on the sheet P. The sheet P is then ejected by an ejecting roller 56 to the folding processing apparatus 1.

In a case of duplex printing, after the color image is fixed on one surface of the sheet P, the sheet P is switched by the switching claw 55 and conveyed to the sheet reversing device 68, where the sheet P is reversed to enter into the secondary transfer nip unit again. After another color image is recorded on the other surface of the sheet P at the secondary transfer nip unit, the sheet P is ejected to the folding processing apparatus 1 by the ejecting roller 56.

After transferring the color image onto the sheet P at the secondary transfer nip unit, the intermediate transfer belt 10 has residual toner remaining on its surface. The residual toner thereon is removed by the belt cleaning device 27 to prepare for the next image forming by the tandem image forming unit 60.

Figure 4:
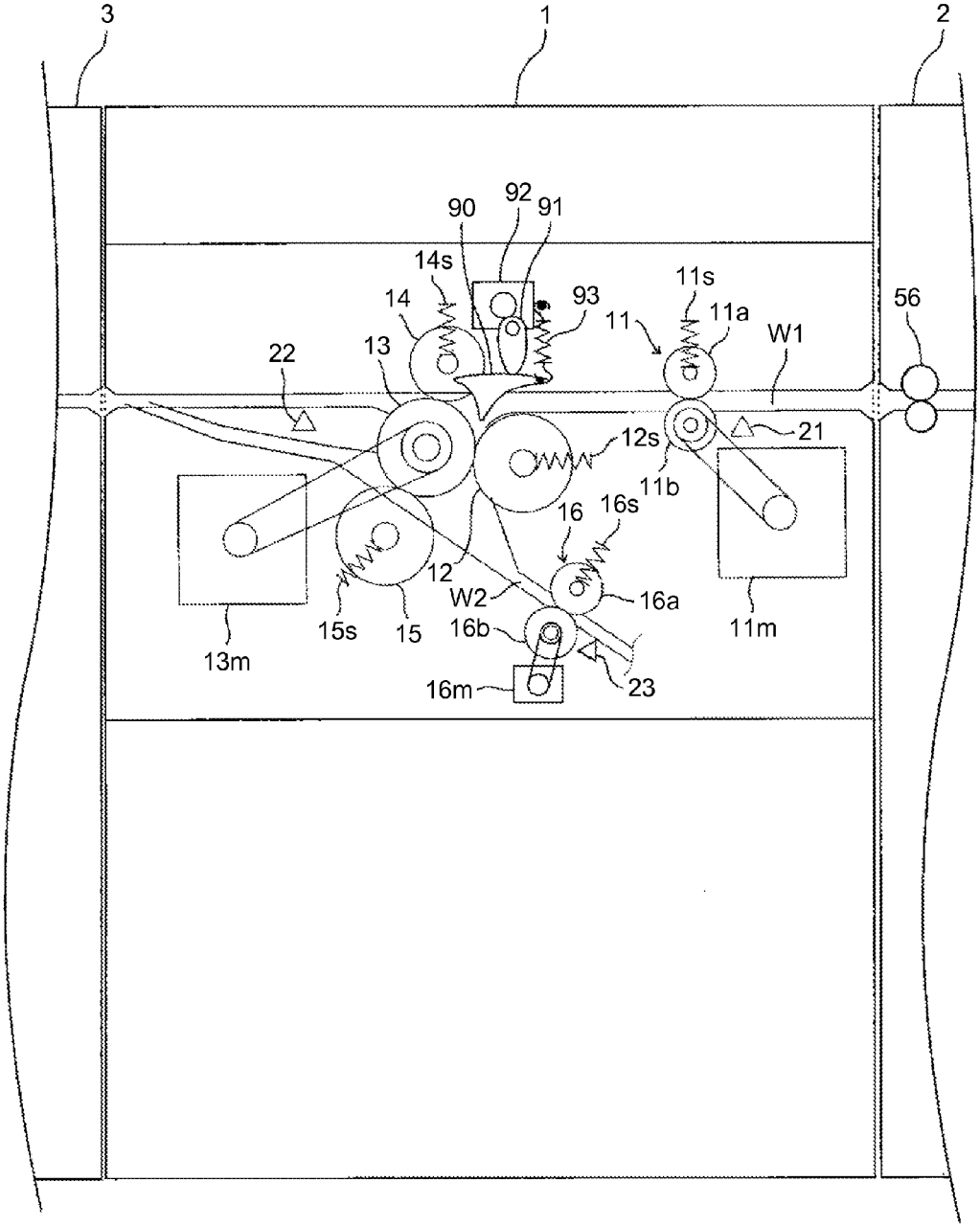
FIG. 4 is a schematic configuration diagram of the folding processing apparatus equipped for the image forming system according to the embodiment.

FIG. 4 is a schematic configuration diagram of the folding processing apparatus 1 equipped for the image forming system according to the embodiment.

The folding processing apparatus 1 according to the present embodiment includes a through conveying path W1 through which the sheet P ejected from the image forming apparatus 2 is conveyed down to the sheet post-processing apparatus 3 without receiving folding processing. The folding processing apparatus 1 also includes a bifurcate conveying path W2 that bifurcates from the through conveying path W1. In the branch conveying path W2, folding processing is performed on the sheet P ejected from the image forming apparatus 2 and through which the sheet P is conveyed down to the sheet post-processing apparatus 3.

A pair of entrance rollers 11 as a first sheet conveying unit is disposed on an entrance side (on the right in FIG. 4) of the through conveying path W1 from which the sheet P ejected from the image forming apparatus 2 enters. The pair of entrance rollers 11 is composed of a pressing roller 11*a* as a rotation member, and a driving roller 11*b* as an opposite member. The driving roller 11*b* is rotationally driven by the driving force of an entrance motor him as a driving source.

On an exit side (on the left in FIG. 4) of the through conveying path W1, disposed are a first folding roller 12, a first forward reverse rotation roller 13 disposed in contact with the first folding roller 12, and a pressing roller 14 disposed in contact with the first forward reverse rotation roller 13. The sheet P can move from the through conveying path W1 to the branch conveying path W2 through a nip between the first folding roller 12 and the first forward reverse rotation roller 13. The sheet P can be conveyed down to the sheet post-processing apparatus 3 through the through conveying path W1 by passing through a nip between the first forward reverse rotation roller 13 and the pressing roller 14.

The folding processing apparatus 1 according to the present embodiment includes a second folding roller 15 disposed in contact with the first forward reverse rotation roller 13 on an exit side of the branch conveying path W2. On the branch conveying path W2, a pair of second forward reverse rotation rollers 16 is disposed on the opposite side of the second folding roller 15 across the nip between the first folding roller 12 and the first forward reverse rotation roller 13 through which the sheet P enters from the through conveying path W1. The pair of second forward reverse rotation rollers 16 is composed of a pressing roller 16*a* as a rotation member, and a driving roller 16*b* as an opposite member. The driving roller 16*b* is rotationally driven by the driving force of a second forward reverse rotation motor 16*m* as a driving source.

The first forward reverse rotation roller 13 can be rotationally driven in both directions of forward and reverse rotation by the driving force of the first forward reverse rotation motor 13*m* that can rotate in both directions of forward and reverse rotation. The first folding roller 12, the pressing roller 14, and the second folding roller 15 each disposed in contact with the first forward reverse rotation roller 13 are driven rollers that are rotationally driven by the rotation of the first forward reverse rotation roller 13.

The driving roller 16*b* of the pair of second forward reverse rotation rollers 16 can be rotationally driven in both directions of forward and reverse rotation by the driving force of the second forward reverse rotation motor 16*m* that can rotate in both directions of forward and reverse rotation. The pressing roller 16*a* of the pair of second forward reverse rotation rollers 16 is a driven roller that is rotationally driven by the rotation of the driving roller 16*b*.

According to the present embodiment, all the driven rollers have biasing units that are pressing springs 11*s*, 12*s*, 14*s*, 15*s*, and 16*s*. The pressing springs apply bias to roller shafts of the respective driven rollers, thereby forming nips between the driven rollers and the rollers opposite to the driven rollers.

The folding processing apparatus 1 of the present embodiment includes an entrance sensor 21 as a sheet end portion detection unit for detecting an end portion of the sheet P. The entrance sensor 21 is disposed upstream (the entrance side of the through conveying path W1) of the pair of entrance rollers 11 in the sheet conveying direction. When a leading end of the sheet P conveyed from the image forming apparatus 2 arrives at a detection region of the entrance sensor 21, the entrance sensor 21 outputs a leading end detection signal indicating the arrival of the leading end of the sheet P to a controller (not illustrated). Various known sensors can be used as the entrance sensor 21.

The folding processing apparatus 1 of the present embodiment also includes a sheet detection sensor 22 as a sheet leading end detection unit for detecting the leading end of the sheet P. The sheet detection sensor 22 is disposed downstream (the exit side of the through conveying path W1) of the second sheet conveying unit composed of the first forward reverse rotation roller 13 and the pressing roller 14 in the sheet conveying direction. When the leading end of the sheet P conveyed in the through conveying path W1 arrives at a detection region of the sheet detection sensor 22, the sheet detection sensor 22 outputs a leading end detection signal indicating the arrival of the leading end of the sheet P to the controller (not illustrated). Various known sensors can be used as the sheet detection sensor 22 as described in the case of the entrance sensor 21.

The folding processing apparatus 1 of the present embodiment includes a sheet detection sensor 23 for detecting a leading end of the sheet P. The sheet detection sensor 23 is disposed downstream (the opposite side of the exit of the branch conveying path W2) of the pair of second forward reverse rotation rollers 16 in the sheet conveying direction. When the leading end of the sheet P sent from the through conveying path W1 to the branch conveying path W2 arrives at a detection region of the sheet detection sensor 23, the sheet detection sensor 23 outputs a leading end detection signal indicating the arrival of the leading end of the sheet P to the controller (not illustrated). Various known sensors can be used as the sheet detection sensor 23 as described in the cases of the entrance sensor 21 and the sheet detection sensor 22.

In the present embodiment, the first forward reverse rotation roller 13 and the pressing roller 14 constitute the second sheet conveying unit, and the first folding roller 12 and the first forward reverse rotation roller 13 constitute the first folded part forming unit. The first forward reverse rotation roller 13 and the second folding roller 15 constitute the second folded part forming unit in the present embodiment.

The second sheet conveying unit may be configured by not using a pair of rollers, but using an adhesive roller or an absorption belt. In the present embodiment, the first forward reverse rotation roller 13 of the second sheet conveying unit, and the first forward reverse rotation roller 13 and the second folding roller 15 of the folded part forming unit are identical. Instead, the second sheet conveying unit and the folded part forming unit may be configured independently by using separate rollers.

Figure 5:
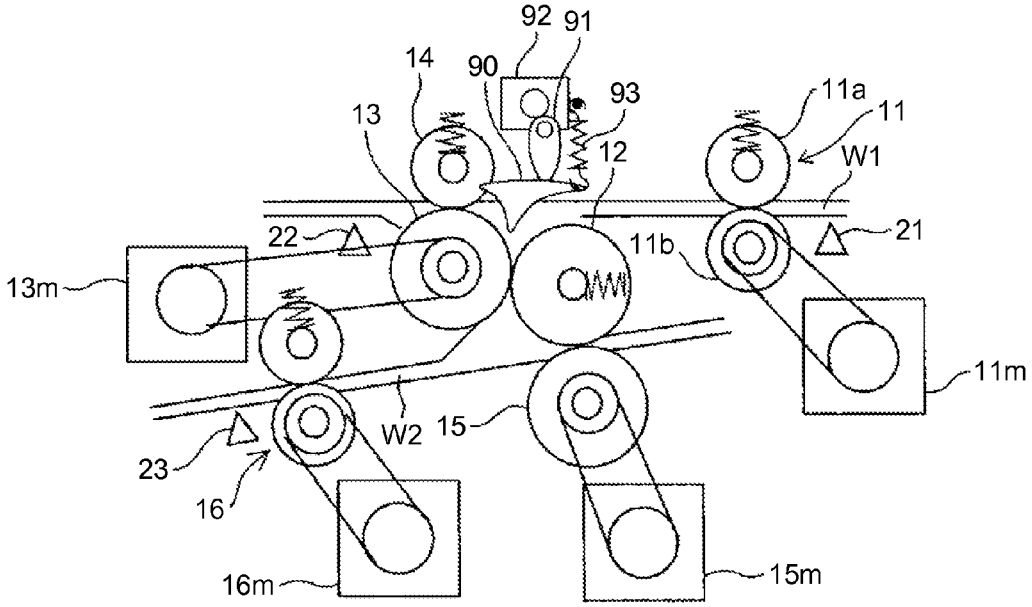
FIG. 5 is a schematic diagram illustrating an example of another configuration of the folding processing apparatus that includes a second sheet conveying unit and a folded part forming unit separately.

FIG. 5 is a schematic diagram illustrating an example of another configuration of the folding processing apparatus 1 that includes the second sheet conveying unit and the folded part forming unit separately.

The folding processing apparatus 1 illustrated in FIG. 5 includes the second folding roller 15, which is disposed in contact with the first forward reverse rotation roller 13 in the folding processing apparatus 1 illustrated in FIG. 4, that is disposed in contact with the first folding roller 12, so that the first folding roller 12 and the second folding roller 15 constitute the folded part forming unit. The second folding roller 15 can be rotationally driven in both directions of forward and reverse rotation by driving force applied by a third forward reverse rotation motor 15*m* that is rotatable in both directions of forward and reverse rotation.

In the folding processing apparatus illustrated in FIG. 5, the exit of the branch conveying path W2 lies in a direction toward the entrance side of the through conveying path W1, which is contrary to that of the folding processing apparatus 1 illustrated in FIG. 4.

Figure 6:
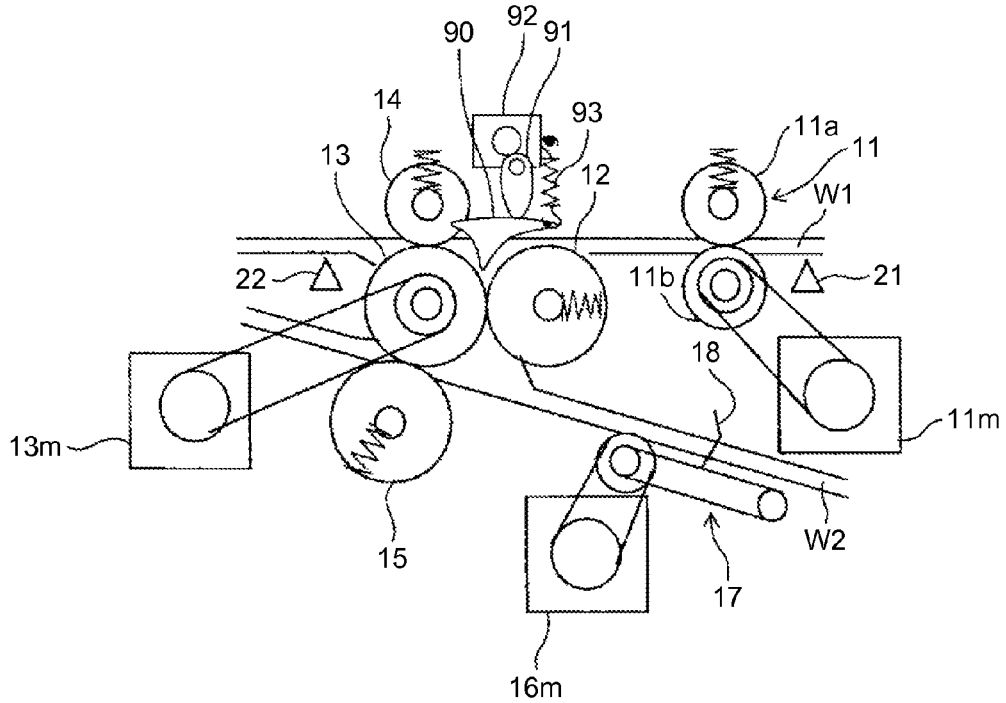
FIG. 6 is a schematic diagram illustrating an example of still another configuration of the folding processing apparatus that includes a leading end stopper instead of a pair of second forward reverse rotation rollers.

FIG. 6 is a schematic diagram illustrating an example of still another configuration of the folding processing apparatus 1 that includes a leading end stopper 18 instead of the pair of second forward reverse rotation rollers 16.

The leading end stopper 18 used in the folding processing apparatus 1 illustrated in FIG. 6 is disposed on the outer surface of an endless belt 17 that is looped over two tension rollers. One of the tension rollers over which the endless belt 17 is looped is a driving roller that can be rotationally driven in both directions of forward and reverse rotation by driving force of the second forward reverse rotation motor 16*m*. The endless belt 17 is thus rotatably driven in both directions of forward and reverse rotation, thereby changing the position of the leading end stopper 18 disposed on the endless belt 17 in the sheet conveying direction on the branch conveying path W2. It should be noted that the folding processing apparatus 1 illustrated in FIG. 4 can be smaller in size than that illustrated in FIG. 6.

Figure 7:
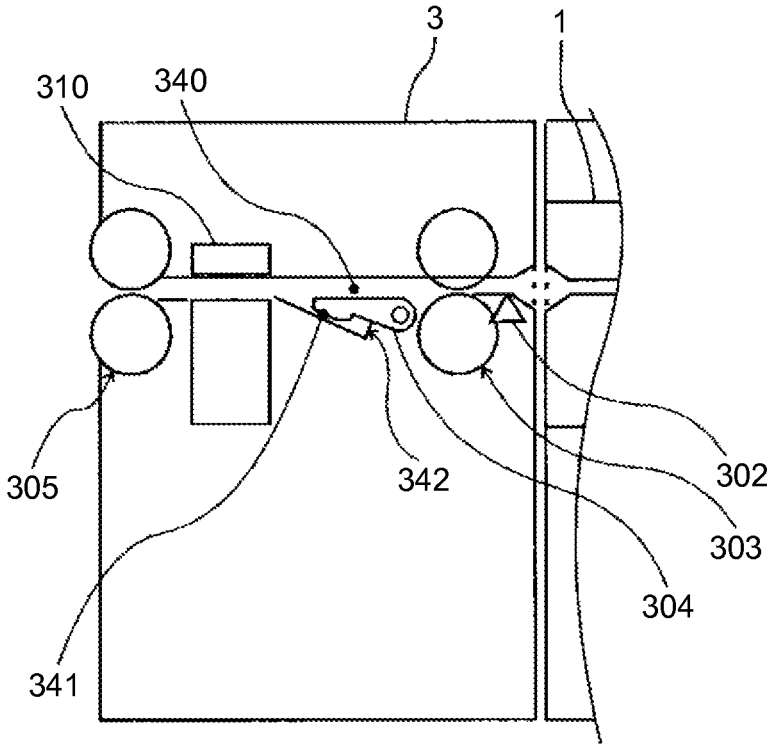
FIG. 7 is a schematic configuration diagram of a sheet post-processing apparatus equipped for the image forming system according to the present embodiment.

FIG. 7 is a schematic configuration diagram of a sheet post-processing apparatus 3 equipped for the image forming system according to the present embodiment.

The sheet post-processing apparatus 3 includes an entrance sensor 302, a pair of entrance rollers 303, a bifurcating claw 304, a pair of ejecting rollers 305, a stitching device 310, a conveying path 340, and a branch path 341.

The entrance sensor 302 detects the leading end and the trailing end of the sheet P and the presence or absence of the sheet P.

The pair of entrance rollers 303 is disposed at the entrance of the sheet post-processing apparatus 3, and has a function of introducing the sheet P into the sheet post-processing apparatus 3. Abutting skew correction of the sheet P is possible with a roller nip of the pair of entrance rollers 303. The pair of entrance rollers 303 is driven by a controllable driving source (not illustrated). The driving source is controlled by a controller (not illustrated), and the controller controls the driving source to rotationally drive or stop the pair of entrance rollers 303, so that a conveying amount of the sheet P is controlled by the rotation of the pair of entrance rollers 303. The controller may be provided in the image forming apparatus 2.

The conveying path 340 is a normal path through which the sheet P is conveyed and ejected. The branch path 341 is provided for stacking and aligning the sheet P. The sheet P reverses in the conveying path 340 to enter the branch path 341 from the trailing end thereof.

The bifurcating claw 304 is a claw member that is rotatably disposed in the conveying path 340 and that switches paths so that the trailing end of the sheet P is guided from the conveying path 340 into the branch path 341. The bifurcating claw 304 can press the sheet P to the conveying surface of the branch path 341, whereby the sheet P can be fixed.

The stitching device 310 is a device to stitch a sheet bundle that has been aligned in the branch path 341 without using a metallic staple. The stitching device 310 in the present embodiment uses a pair of tooth forms having convex and concave portions on the surfaces to stitch the sheet bundle by pinching it so that sheets P is distorted and fibers thereof are tangled. A stitching device may also be used that cuts a u-shaped slit through the sheet bundle and bends the u-shaped part to insert into a slit that has been cut together with the u-shaped slit near a bent part, so that the sheet bundle is stitched without using a metallic staple. A stitching unit to stitch a sheet bundle is not limited to the stitching device according to the present embodiment, but may be a stitching device that has a common stitching function.

The pair of ejecting rollers 305 is disposed at the exit of the sheet post-processing apparatus 3, and has a function of discharging the sheet bundle stitched by the stitching device 310 to a discharge tray (not illustrated). The pair of ejecting rollers 305 is driven by a controllable driving source (not illustrated). The driving source is controlled by the controller, and the controller controls the driving source to rotationally drive or stop the pair of ejecting rollers 305, so that a conveying amount of the sheet P is controlled by the rotation of the pair of ejecting rollers 305.

Figure 8:
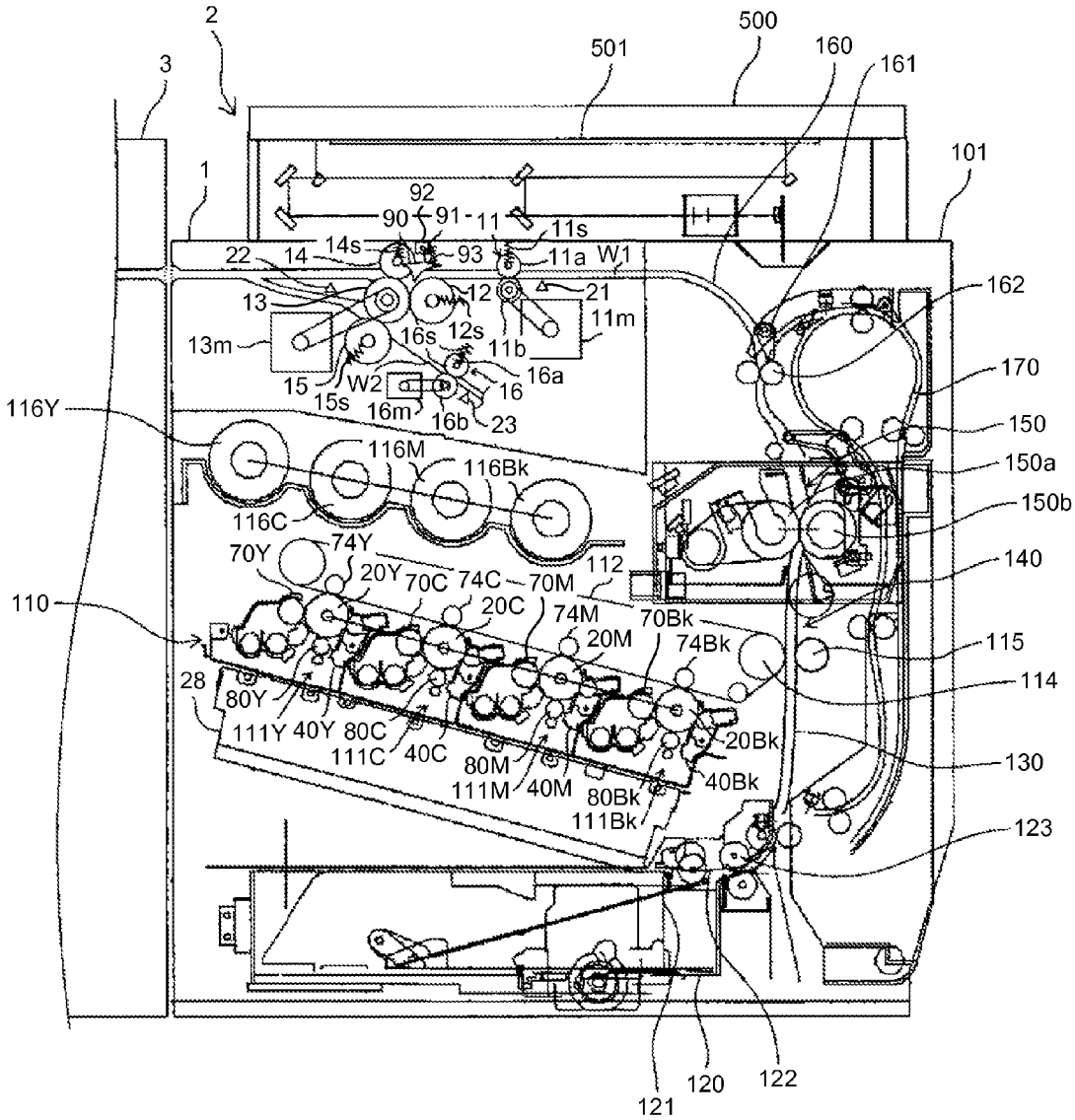
FIG. 8 is an explanatory diagram for explaining another example of the image forming system equipped with the folding processing apparatus according to the embodiment.
Figure 9A:
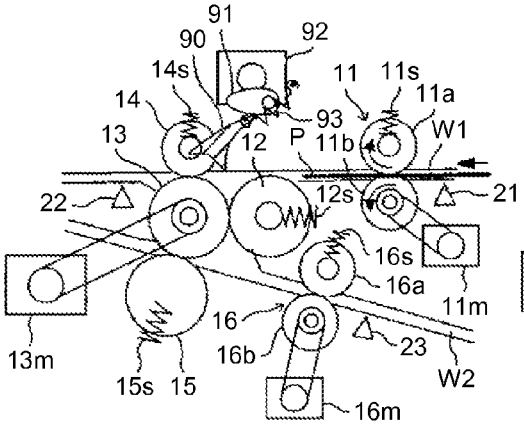
Figure 9B:
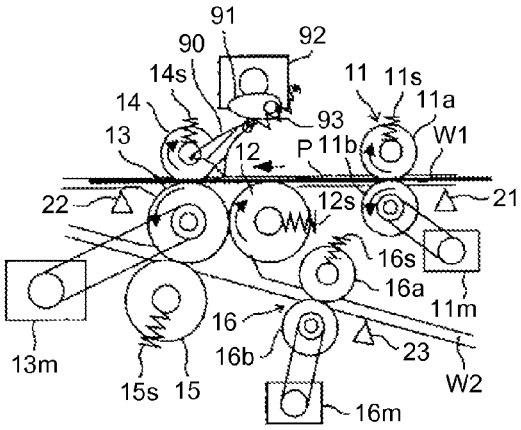
Figure 9C:
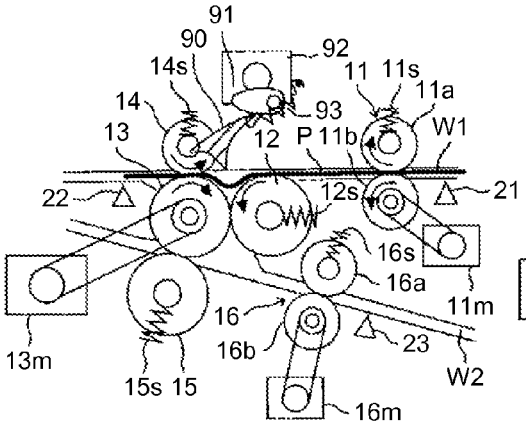
Figure 9D:
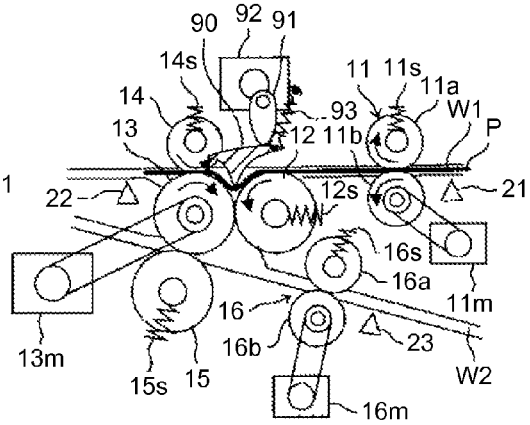
Figure 9E:
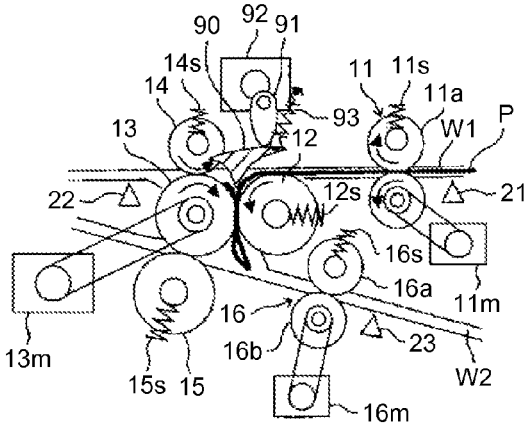

FIG. 8 is an explanatory diagram for explaining another example of the image forming system equipped with the folding processing apparatus according to the present embodiment.

The folding processing apparatus 1 according to this example forms a folded part on the sheet P inside the image forming apparatus 2. The image forming system according to this example also includes the sheet post-processing apparatus 3 that performs post processing on either of a sheet P on which a folded part is formed by the folding processing apparatus 1, and a sheet P on which a folded part is not formed by the folding processing apparatus 1.

FIG. 8 is a schematic configuration diagram of the image forming apparatus 2 in which the folding processing apparatus 1 is disposed inside the apparatus body of the image forming apparatus 2. As illustrated in FIG. 10, the image forming apparatus 2 includes an image forming apparatus body 101, the folding processing apparatus 1, and an image reading device 500.

The image forming apparatus body 101 is a tandem color image forming apparatus using an indirect transfer method. The image forming apparatus body 101 includes an image forming unit 110 that is constituted of image forming stations 111Y, 111C, 111M, and 111K in four colors illustrated in almost middle of FIG. 10. Below the image forming unit 110, disposed is an optical writing device 28 adjacent to the image forming unit 110. Below the optical writing device 28, disposed is a feeding unit 120. The image forming apparatus body 101 also includes a feed conveying path (vertical conveying path) 130 that conveys the sheet P fed from the feeding unit 120 to a secondary transfer unit 140 and to a fixing device 150; an ejecting conveying path 160 that conveys the sheet P on which an image has been fixed by the fixing device 150 to the folding processing apparatus 1; and a duplex conveying path 170 that reverses the sheet P with an image formed on one surface thereof in order to form another image on the other surface of the sheet P.

The image forming unit 110 includes photosensitive element drums 20Y, 20C, 20M, and 20K in four colors for the image forming stations 111Y, 111C, 111M, and 111K, respectively. Around the periphery of the photosensitive element drums 20Y, 20C, 20M, and 20K, disposed are charging devices 80Y, 80C, 80M, and 80K, developing devices 70Y, 70C, 70M, and 70K, cleaning units 40Y, 40C, 40M, and 40K, and neutralization units (not illustrated), respectively. The image forming apparatus main body 101 includes an intermediate transfer belt 112 to which images formed on the respective photosensitive element drums 20Y, 20C, 20M, and 20K are intermediate transferred by primary transfer rollers 74Y, 74C, 74M, and 74K, respectively. The optical writing device 28 is provided to write images in four colors on the photosensitive element drums 20Y, 20C, 20M, and 20K, respectively.

The optical writing device 28 is disposed below the image forming stations 111Y, 111C, 111M, and 111K, and the intermediate transfer belt 112 is disposed above the image forming stations 111Y, 111C, 111M, and 111K. Above the image forming unit 110, disposed in a replaceable manner are toner containers 116Y, 116C, 116M, and 116K each containing toner that is supplied to the developing devices 70Y, 70C, 70M, and 70K.

The intermediate transfer belt 112 is rotatably supported by a plurality of supporting rollers. At the secondary transfer unit 140, a supporting roller 114 of the supporting rollers is disposed opposite to a secondary transfer roller 115 across the intermediate transfer belt 112, so that an image on the intermediate transfer belt 112 can be secondary transferred to the sheet P.

The detailed description is omitted of the image forming procedure of the tandem color image forming apparatus using an indirect transfer method because it is a well-known technology and the gist of the present invention does not have a direct relation to the image forming procedure thereof.

The feeding unit 120 includes a feed tray 121, a pick-up roller 122, and a feed conveying roller 123. The feeding unit 120 sends a sheet P picked up from the feed tray 121 upward along the feed conveying path 130.

The sheet P thus sent is conveyed to the secondary transfer unit 140 at which an image is secondary transferred to the sheet P, and then, the sheet P is conveyed to the fixing device 150. The fixing device 150 includes a fixing roller 150*a* and a pressing roller 150*b*. When the sheet P passes through a nip between these rollers, the fixing device 150 applies heat and pressure to the sheet P, thereby fixing toner on the sheet P.

Downstream of the fixing device 150, the conveying path bifurcates at a bifurcating claw 161 to be the ejecting conveying path 160 and the duplex conveying path 170 extending in two directions that are selected depending on a case in which the sheet P is conveyed to the folding processing apparatus 1 or a case in which the sheet P is conveyed to the duplex conveying path 170.

A bifurcating conveying roller 162 is disposed immediately upstream of the bifurcating claw 161, and applies conveying force to the sheet P.

The folding processing apparatus 1 is disposed inside the image forming apparatus body 101, and performs folding processing on the sheet P conveyed from the image forming apparatus body 101 after an image is formed thereon, and ejects the sheet P to the sheet post-processing apparatus 3 illustrated in FIG. 8.

The image reading device 500 is a technically well-known device that reads an image on a document set on an exposure glass 501 through optical scan. The configuration and function of the image reading device 500 is well known and the gist of the present invention does not have a direct relation to it, thus detailed description thereof is omitted.

The image forming apparatus body 101 thus configured generates image data used for writing on the basis of document data that has been read by the image reading device 500, or print data that has been transferred from an external apparatus such as a personal computer. On the basis of the image data, the optical writing device 28 performs optical writing on the photosensitive element drums 20Y, 20C, 20M, and 20K. Images of respective four colors are formed at the respective image forming stations 111Y, 111C, 111M, and 111K, and are sequentially transferred on the intermediate transfer belt 112, thereby forming a color image with four colors that are superimposed on the intermediate transfer belt 112.

In conjunction with the image forming described above, a sheet P is fed from the feed tray 121. The sheet P is stopped temporarily at the position of a registration roller (not illustrated) immediately before the secondary transfer unit 140, and then sent out in synchronization with a timing at which the image on the intermediate transfer belt 112 is sent. The image is secondary transferred to the sheet P at the secondary transfer unit 140, and the sheet P is sent to the fixing device 150.

The fixing device 150 fixes the image on the sheet P, and then, the sheet P is conveyed to the ejecting conveying path 160 by the switching operation by the bifurcating claw 161 in a case of single-sided printing, or in a case of completing printing on both surfaces of the sheet P in duplex printing mode. The sheet P is conveyed to the duplex conveying path 170 in a case of printing on the second surface of the sheet P in duplex printing mode.

The sheet P conveyed to the duplex conveying path 170 is reversed therein, and sent again to the secondary transfer unit 140. After another image is formed on the other surface of the sheet P, the sheet P is sent back to the ejecting conveying path 160.

The sheet P thus conveyed to the ejecting conveying path 160 is then conveyed to the folding processing apparatus 1. After receiving folding processing, or without receiving folding processing in the folding processing apparatus 1, the sheet P is ejected to the sheet post-processing apparatus 3.

The image forming system uses the sheet post-processing apparatus 3 illustrated in FIG. 7, thus detailed description thereof is omitted.

Figure 1:
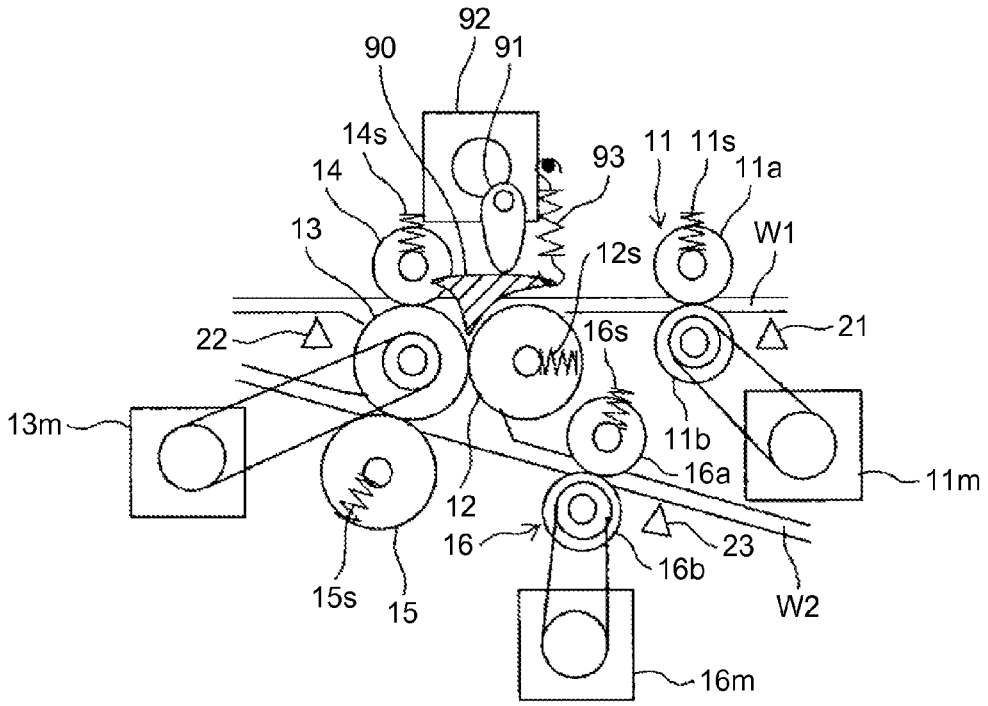
FIG. 1 is a diagram for explaining a configuration of a folding processing apparatus 1 according to an embodiment.

Next, described is a characteristic part of the folding processing apparatus 1 according to the present embodiment. FIG. 1 is a diagram for explaining a configuration of the folding processing apparatus 1 according to the embodiment.

The folding processing apparatus 1 includes a guide member 90 disposed between the pair of entrance rollers 11 and the second sheet conveying unit (the first forward reverse rotation roller 13 and the pressing roller 14) in the sheet conveying direction in the through conveying path W1. The guide member 90 is moved by a driving mechanism that includes a driving motor 92, a cam 91, and a tension spring 93, so that the guide member 90 is movable between a pushing position at which the guide member 90 pushes a bent portion (turned-back portion) of the sheet P toward the nip of the first folded part forming unit and a retracted position at which the guide member 90 is retracted from the pushing position.

In the pushing position, the guide member 90 guides a bent portion (turned-back portion) of the sheet P to the nip of the first folded part forming unit. Further, by positioning the guide member 90 in the pushing position, the leading end of the sheet P that is conveyed in the through conveying path W1 from the pair of entrance rollers 11 toward the second sheet conveying unit can be guided toward the branch conveying path W2. Therefore, the pushing position is hereinafter referred to as a guide position.

FIGS. 9A to 9E are diagrams for explaining the operation of the guide member 90 to guide a bent portion (turned-back portion) of the sheet P to the nip of the first folded part forming unit.

When the entrance sensor 21 detects the leading end of the sheet P, the pair of entrance rollers 11 starts rotation. While the sheet P is conveyed from the pair of entrance rollers 11 to the pressing roller 14, the guide member 90 is in the retracted position, thus the guide member 90 does not block the sheet P.

After the sheet detection sensor 22 detects the leading end of the sheet P, the folding processing apparatus 1 continues to convey the sheet P until the leading end of the sheet P protrudes from the nip position between the pressing roller 14 and the first forward reverse rotation roller 13 by a predetermined protrusion amount. This protrusion amount is determined depending on a sheet length or a folding pattern, and is determined by an amount of rotation of the pressing roller 14.

When the leading end of the sheet P protrudes by a predetermined protrusion amount, the pressing roller 14 starts reverse rotation in the reverse conveying direction with the pair of entrance rollers 11 kept rotating in the conveying direction, thereby forming a bent portion (turned-back portion) on the sheet P. About or simultaneously with the timing at which the pressing roller 14 starts reverse rotation, the guide member 90 is moved from the retracted position to the guide position, so that the bent portion (turned-back portion) of the sheet P is pushed by the guide member 90. This allows the bent portion (turned-back portion) to be introduced into the nip between the first folding roller 12 and the first forward reverse rotation roller 13 constituting the first folded part forming unit and a folded part can be formed on the sheet P.

Next, described is the procedure of the operation of folding processing performed by the folding processing apparatus 1 to form a folded part on the sheet P.

Figure 10A:
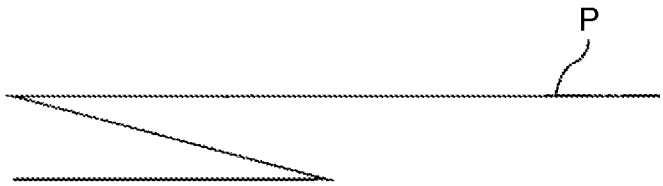
FIGS. 10A to 10C are explanatory diagrams each illustrating an example of folded parts formed through folding processing performed by the folding processing apparatus.
Figure 10B:
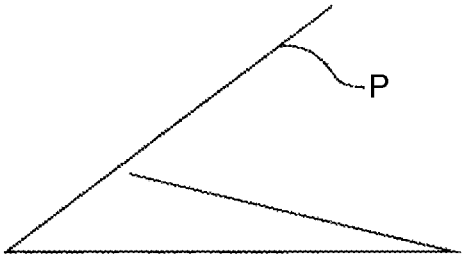
Figure 10C:
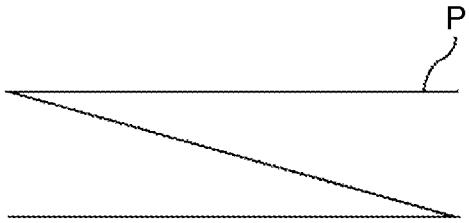

FIGS. 10A to 10C are explanatory diagrams each illustrating an example of folded parts formed through folding processing performed by the folding processing apparatus 1 according to the present embodiment.

The folding processing apparatus 1 according to the present embodiment can perform z-shaped fold processing in which two outer folded parts are formed on the sheet P to make a z-shaped fold as illustrated in FIG. 10A. The folding processing apparatus 1 according to the present embodiment can perform inner-threefold processing in which two inner folded parts are formed on the sheet P such that the folded parts divide the sheet P into three nearly equal parts as illustrated in FIG. 10B. The folding processing apparatus 1 according to the present embodiment can perform outer-threefold processing in which two outer folded parts are formed on the sheet P such that the folded parts divide the sheet P into three nearly equal parts as illustrated in FIG. 10C.

FIGS. 11A to 11H are explanatory diagrams for explaining the general procedure of z-shaped folding processing performed by the folding processing apparatus 1.

Figure 11A:
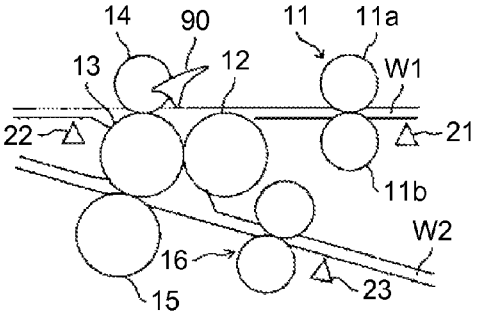
Figure 11E:
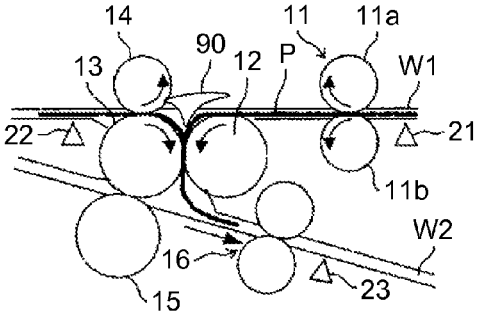
Figure 11B:
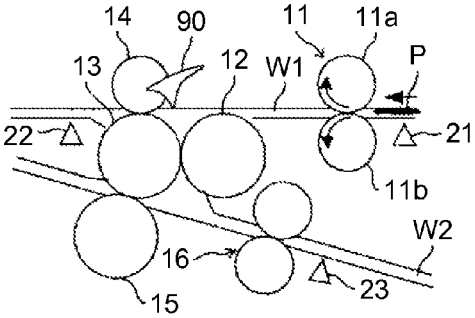
Figure 11F:
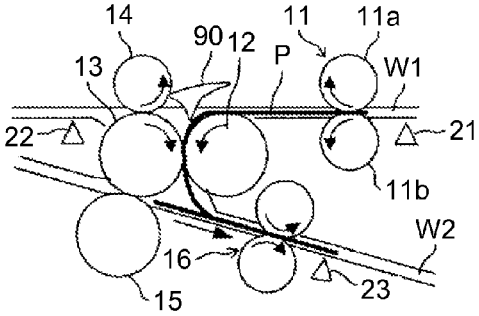
Figure 11C:
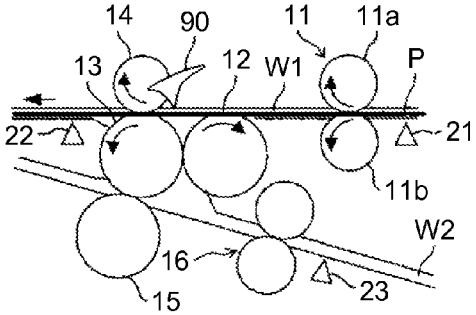

An ejecting roller (not illustrated) of the image forming apparatus 2 applies conveying force to convey the sheet P. The leading end of the sheet P is detected by the entrance sensor 21, and then, the entrance sensor 21 outputs a leading end detection signal to the controller (not illustrated). When receiving the signal, the controller controls the entrance motor 11*m* to start rotation of the pair of entrance rollers 11 (FIGS. 11A and 11B). The guide member 90 is in the retracted position when the sheet P is conveyed from the pair of entrance rollers 11 to the pressing roller 14.

When the leading end of the sheet P enters into the nip between the pair of entrance rollers 11, the sheet P also receives conveying force from the pair of entrance rollers 11, and is conveyed in the through conveying path W1 toward the exit side thereof.

The leading end of the sheet P conveyed in the through conveying path W1 enters into the nip between the first forward reverse rotation roller 13 and the pressing roller 14. After passing through the nip, the leading end of the sheet P is detected by the sheet detection sensor 22. The controller receives a leading end detection signal from the sheet detection sensor 22 that has detected the leading end of the sheet P, and controls in the following manner. That is, when the leading end of the sheet P protrudes from the nip position between the first forward reverse rotation roller 13 and the pressing roller 14 by a predetermined protrusion amount (FIG. 11C), the controller controls the first forward reverse rotation motor 13*m* to stop the rotation of the first forward reverse rotation roller 13. The controller also controls the entrance motor 11*m* to stop the rotation of the driving roller 11*b* of the pair of entrance rollers 11.

The protrusion amount is determined each time depending on the length of the sheet P in the sheet conveying direction, and the content of the folding processing (such as a folding type). The protrusion amount of the leading end of the sheet P can be acquired, for example, by a reception timing of the leading end detection signal output from the sheet detection sensor 22 and an amount of rotation of the pressing roller 14.

Figure 11G:
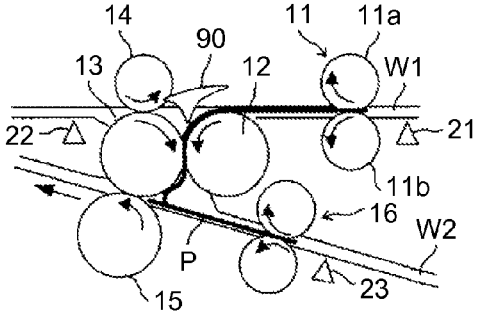
Figure 11D:
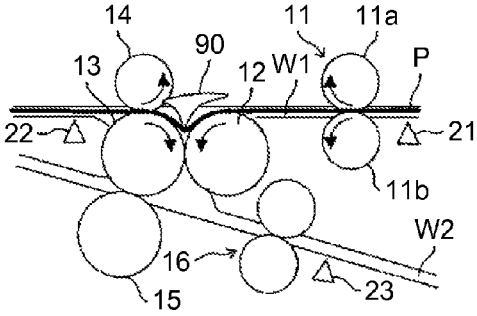

The controller then controls the first forward reverse rotation motor 13*m* to start reverse rotation of the first forward reverse rotation roller 13 so that the sheet P is reversed toward the entrance side of the through conveying path W1. The controller also causes the pair of entrance rollers 11 to start rotating. A bend is thus formed on a part of the sheet between the pair of entrance rollers 11 and the first forward reverse rotation roller 13 (FIG. 11D). About or simultaneously with the timing at which the first forward reverse rotation roller 13 starts reverse rotation, the guide member 90 is moved from the retracted position to the guide position, so that a bent portion (turned-back portion) of the sheet P is pushed by the guide member 90.

This bent portion (turned-back portion) enters into the nip between the first folding roller 12 and the first forward reverse rotation roller 13, thereby forming a first folded part at the turned-back portion. After passing through the nip between the first folding roller 12 and the first forward reverse rotation roller 13, the first folded part enters the branch conveying path W2 (FIG. 11E), and the sheet P is conveyed in the branch conveying path W2 to the pair of second forward reverse rotation rollers 16.

The first folded part of the sheet P enters into the nip between the pair of second forward reverse rotation rollers 16. After passing through the nip, the first folded part is detected by the sheet detection sensor 23. The controller receives a leading end detection signal from the sheet detection sensor 23 that has detected the first folded part of the sheet P, and controls in the following manner. That is, when the first folded part of the sheet P protrudes from the nip position between the pair of second forward reverse rotation rollers 16 by a predetermined protrusion amount (FIG. 11F), the controller controls the first forward reverse rotation motor 13*m* to stop rotation of the first forward reverse rotation roller 13. At the same time, the controller stops the rotation of the pair of second forward reverse rotation rollers 16 and the pair of entrance rollers 11. The protrusion amount at this time is also determined each time depending on the length of the sheet P in the sheet conveying direction, and the content of the folding processing (such as a folding type). The protrusion amount of the first folded part of the sheet P can be acquired, for example, by a reception timing of the leading end detection signal output from the sheet detection sensor 23 and an amount of rotation of the pair of second forward reverse rotation rollers 16.

The controller then controls the second forward reverse rotation motor 16*m* to start reverse rotation of the pair of second forward reverse rotation rollers 16 in a direction in which the sheet P is conveyed to the exit side of the branch conveying path W2. The controller also resumes reverse rotation of the first forward reverse rotation roller 13, and resumes rotation of the pair of entrance rollers 11. A bend is thus formed on a part of the sheet between the first forward reverse rotation roller 13 and the pair of second forward reverse rotation rollers 16 (FIG. 11G). This bent portion (turned-back portion) enters into the nip between the first forward reverse rotation roller 13 and the second folding roller 15, thereby forming a second folded part in the turned-back portion.

Figure 11H:
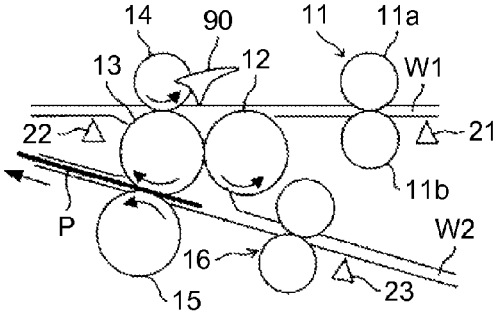
Figure 12A:
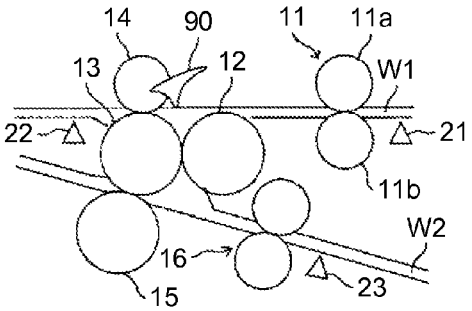
FIGS. 12A to 12H are explanatory diagrams for explaining the general procedure of inner-threefold processing performed by the folding processing apparatus.
Figure 12B:
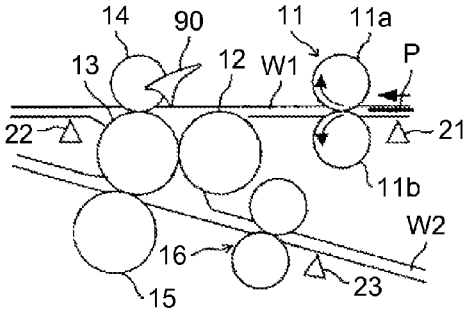
Figure 12C:
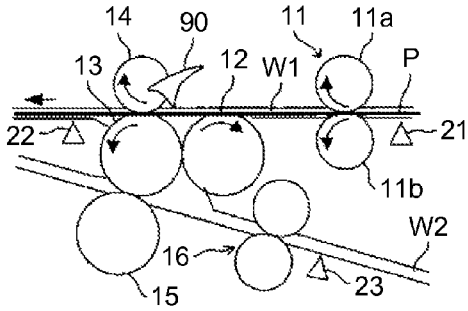
Figure 12D:
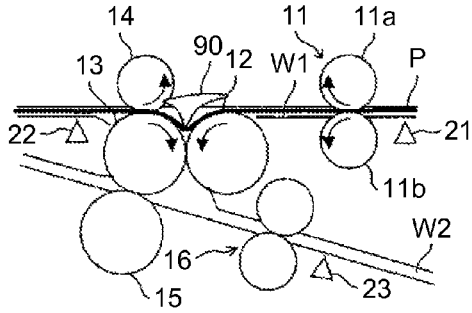
Figure 12E:
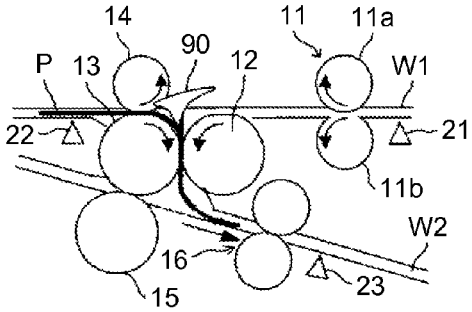
Figure 12F:
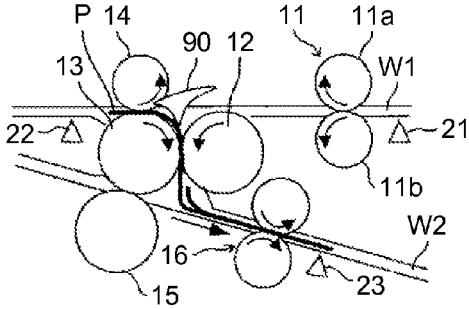
Figure 12G:
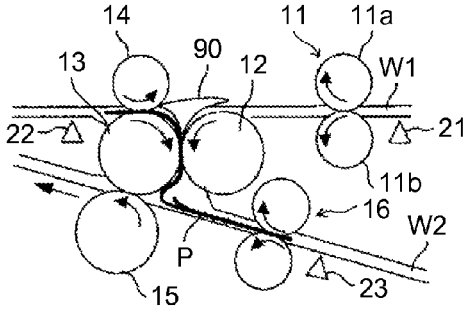
Figure 12H:
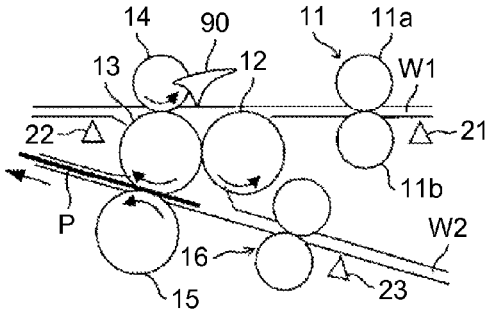
Figure 13A:
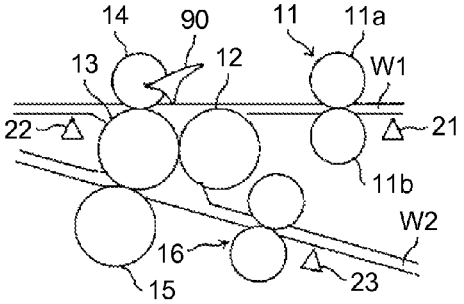
FIGS. 13A to 13H are explanatory diagrams for explaining the general procedure of outer-threefold processing performed by the folding processing apparatus.
Figure 13B:
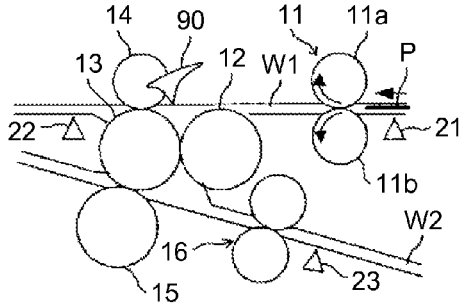
Figure 13C:
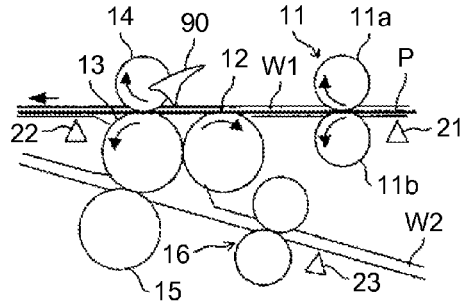
Figure 13D:
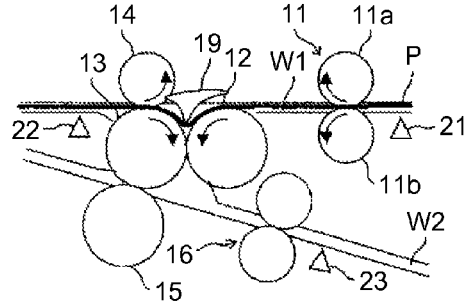
Figure 13E:
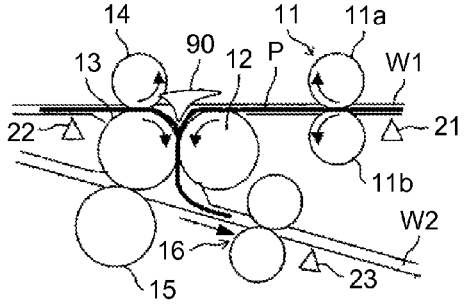
Figure 13F:
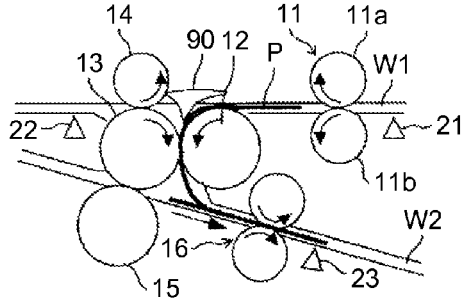
Figure 13G:
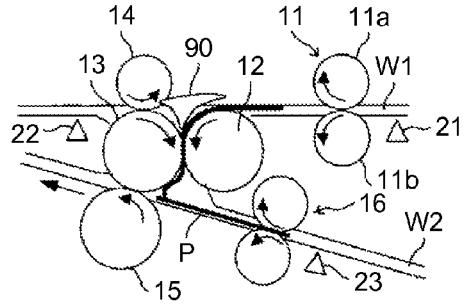
Figure 13H:
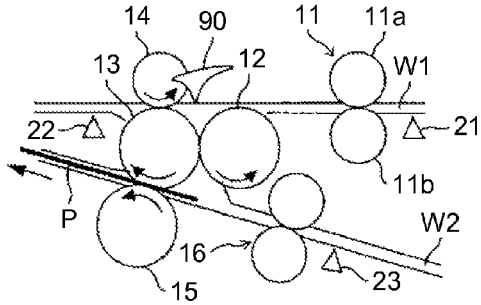

After the second folded part passes through the nip between the first forward reverse rotation roller 13 and the second folding roller 15, the sheet P is conveyed to the exit side of the branch conveying path W2 (FIG. 11H). The sheet P on which the first and the second folded parts are formed is conveyed down to the sheet post-processing apparatus 3 by receiving conveying force from the first forward reverse rotation roller 13. The guide member 90 is moved from the guide position to the retracted position in preparation for the next processing.

FIGS. 12A to 12H are explanatory diagrams for explaining the general procedure of inner-threefold processing performed by the folding processing apparatus 1.

FIGS. 13A to 13H are explanatory diagrams for explaining the general procedure of outer-threefold processing performed by the folding processing apparatus 1.

The procedure of the operation of the inner-threefold processing and the outer-threefold processing is the same as that of the z-shaped folding processing, but the above-described protrusion amounts are different depending on the types of the folding processing. That is, the z-shaped folding processing, the inner-threefold processing, and the outer-threefold processing differ in that they have different timings at which reverse rotation of the first forward reverse rotation roller 13 and that of the pair of second forward reverse rotation rollers 16 are started.

Figure 14A:
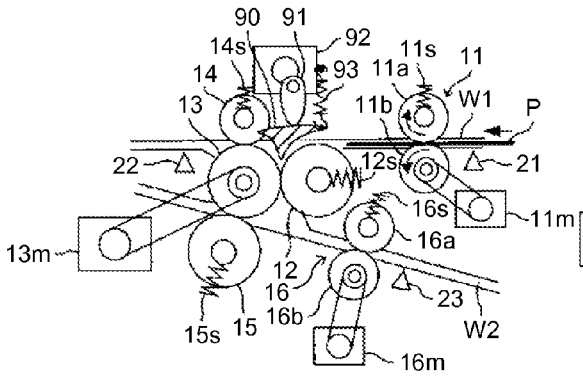
FIGS. 14A to 14C are diagrams for explaining the operation of the guide member to guide the leading end of a sheet to a first folded part forming unit.
Figure 14B:
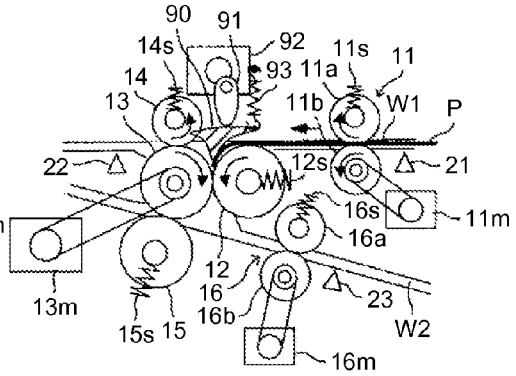
Figure 14C:
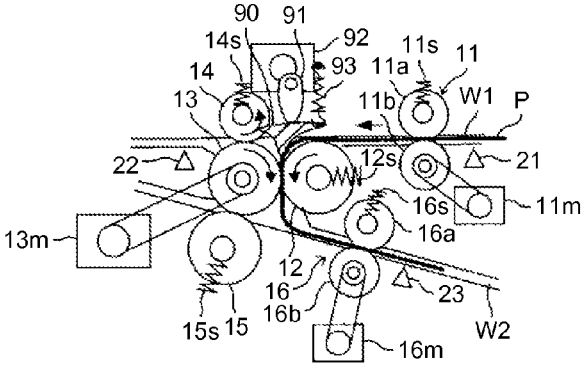

FIGS. 14A to 14C are diagrams for explaining the operation of the guide member 90 to guide the leading end of the sheet P to the nip of the first folded part forming unit when a folded part is not formed on the sheet P by the first folded part forming unit. The guide member 90 changes the direction of the leading end of the sheet to change the course of the sheet P, so that the leading end of the sheet is guided to the nip.

Detecting the leading end of the sheet P by the entrance sensor 21 causes the pair of entrance rollers 11 to start rotation. As illustrated in FIG. 14A, the guide member 90 is moved from the retracted position to the guide position before the leading end of the sheet P conveyed by the pair of entrance rollers 11 reaches the position of the guide member 90 in the through conveying path W1. As illustrated in FIG. 14B, the guide member 90 can thus guide the leading end of the sheet P along a guide surface of the guide member 90 toward the nip between the first forward reverse rotation roller 13 and the first folding roller 12 constituting the first folded part forming unit.

When the leading end of the sheet P reaches the nip between the first forward reverse rotation roller 13 and the first folding roller 12 constituting the first folded part forming unit, the sheet P is conveyed by the pair of entrance rollers 11 and the first folded part forming unit, and is guided to the branch conveying path W2 as illustrated in FIG. 14C.

As described above, in the folding processing apparatus 1 according to the present embodiment, the single guide member 90 can perform two functions: of guiding a bend of a sheet toward the nip between the first forward reverse rotation roller 13 and the first folding roller 12 that constitute the first folded part forming unit; and of changing the course of the leading end of the sheet. Compared with a case in which separate members, such as a folding blade and a bifurcating claw, are provided to carry out these functions, the number of parts or additional installation space for the separate members can be reduced, thereby reducing the size of the apparatus.

Depending on the thickness or the paper type of the sheet P, the folding processing apparatus 1 may determine whether to move the guide member 90 from the retracted position, or how long to move the guide member 90. The guide member 90 is thus driven only for a sheet P that needs guidance of the guide member 90, or driven to move by a necessary moving amount depending on the thickness or the paper type of the sheet P. The folding processing apparatus 1 can reduce energy consumption accordingly.

For example, when the sheet P is thin paper, plain paper, or thick paper, which differs from each other in thickness, the folding processing apparatus 1 does not move the guide member 90 in a case of thin paper that is not stiff, and thus a bend is easy to be formed, whereas the folding processing apparatus 1 moves the guide member 90 in a case of thick paper that is stiff, and thus a bend is difficult to be formed. The guide member 90 is thus driven only for a sheet that needs guidance of the guide member 90. The folding processing apparatus can reduce energy consumption accordingly.

In a case of plane paper that is less stiff than thick paper, a bend of the sheet P can enter into the nip of the first folded part forming unit without guidance of the guide member 90. In the case of plain paper, however, it is preferable to move the guide member 90 to guide a bend of the sheet P into the nip of the first folded part forming unit so that appropriate folding processing is performed without fail.

When the guide member 90 is moved in the cases of thick paper and plain paper, the moving amount of the guide member 90 may be changed between thick paper and plain paper. In other words, the moving amount for plain paper is set to be smaller than that for thick paper that is stiffer than plain paper. The guide member 90 is thus moved by a needed moving amount in accordance with the stiffness of paper depending on the thickness of the sheet P. The folding processing apparatus can reduce energy consumption accordingly. When a moving amount is changed between plain paper and thick paper, the moving amount may be obtained in advance by, for example, experiments.

The sheet P may be paper with a treated surface such as coated paper. In a case in which such a sheet P is used, when the guide member 90 is moved to guide a bend of the sheet P to the nip of the first folded part forming unit, the guide member 90 may damage a part of a surface of the sheet by contacting it, so that the coating on the surface may come off. Thus, in the case in which coated paper, or the like is used as the sheet P, the guide member 90 is set not to move from the retracted position, thereby preventing such a trouble described above.

Irrespective of the thickness of the sheet P such as thin paper, plain paper, or thick paper, stiffness of the sheet P varies depending on the material of the sheet P, for example. Thus, in a case in which a type of sheet that is flexible and easy to bend is used as the sheet P, the guide member 90 is not moved, whereas in a case in which a type of sheet that is stiff and is difficult to bend is used as the sheet P, the guide member 90 is moved. The guide member 90 is thus driven only for a sheet P that needs guidance of the guide member 90. The folding processing apparatus 1 can reduce energy consumption accordingly.

When a type of sheet that is stiff is used as the sheet P, a moving amount of the guide member 90 may be changed depending on the type of the sheet P in accordance with a degree of stiffness thereof. The guide member 90 is thus driven to move by a needed moving amount in accordance with the stiffness of a sheet type of the sheet P. The folding processing apparatus 1 can reduce energy consumption accordingly. When a moving amount of the guide member 90 is changed depending on the type of the sheet P, the moving amount may be obtained in advance, for example, by experiments for each sheet type that is assumed to be used in the folding processing apparatus 1.

The description above is given for illustrative purposes only and the present invention provides particular advantageous effects for each of the aspects below.

Aspect A

Aspect A provides a sheet folding apparatus such as the folding processing apparatus 1 that includes a first conveying path such as the through conveying path W1 in which a sheet such as the sheet P is conveyed; a first sheet conveying unit such as the pair of entrance rollers 11 that holds a part of a sheet conveyed in the first conveying path to apply conveying force to the sheet; a second sheet conveying unit, such as the first forward reverse rotation roller 13 and the pressing roller 14, that is disposed downstream of the first sheet conveying unit in a sheet conveying direction, and holds another part of the sheet to apply conveying force to the sheet; a folded part forming unit such as the first folded part forming unit that forms a folded part on a sheet by nipping a turned-back portion formed on a part of the sheet between the first and the second sheet conveying units; and a second conveying path such as the branch conveying path W2 that bifurcates from the first conveying path, and in which a sheet on which a folded part is formed by the folded part forming unit is conveyed. The sheet folding apparatus includes a pushing member such as the guide member 90 that is movable between a pushing position at which the guide member 90 pushes the turned-back portion towards the folded part forming unit and a retracted position at which the guide member 90 is retracted from the pushing position. The pushing member also serves as a changing unit that changes a direction of a leading end of the sheet that is conveyed in the first conveying path from the first sheet conveying unit toward the second sheet conveying unit into a direction toward the second conveying path. As described in the above embodiment, the sheet folding apparatus can have a function of guiding a turned-back portion of a sheet to the folded part forming unit, and a function of changing the direction of the leading end of the sheet to change the course of the sheet without increasing the size of the apparatus.

Aspect B

According to aspect B, in aspect A, a turned-back portion is formed on a part of the sheet between the first sheet conveying unit and the second sheet conveying unit by holding a part of the sheet by the first sheet conveying unit, and by applying conveying force to the sheet by the second sheet conveying unit to reverse the sheet upstream in the sheet conveying direction. A folded part is formed on the sheet by moving the pushing member from the retracted position to the pushing position to push the turned-back portion to cause the folded part forming unit to nip the turned-back portion. According to this, as described in the above embodiment, the sheet folding apparatus can perform folding processing properly even in a case of using a stiff sheet such as thick paper, although the sheet folding apparatus has difficulty in guiding the turned-back portion formed on the stiff sheet into the folded part forming unit.

Aspect C

According to aspect C, in aspect A or aspect B, the leading end of the sheet conveyed from the first conveying unit is guided from the first conveying path to the second conveying path along a guide surface of the pushing member positioned in the pushing position. According to this, as described in the above embodiment, a sheet can be conveyed properly from the first conveying path to the second conveying path without forming a folded part at the folded part forming unit.

Aspect D

According to aspect D, in any one of aspects A to C, when the folded part forming unit forms a folded part on the sheet, the sheet folding apparatus determines whether to move the pushing member from the retracted position to the pushing position depending on a thickness of the sheet. According to this, as described in the above embodiment, the pushing member is moved only for a sheet that needs guidance of the pushing member. Energy consumption can be reduced accordingly.

Aspect E

According to aspect E, in any one of aspects A to C, when the folded part forming unit forms a folded part on the sheet, the sheet folding apparatus determines whether to move the pushing member from the retracted position to the pushing position depending on a type of the sheet. According to this, as described in the above description, the pushing member is moved only for a sheet that needs guidance of the pushing member. Energy consumption can be reduced accordingly. When a sheet with a treated surface such as a coated sheet is used, the pushing member is not moved from the retracted position to the pushing position, thereby preventing damage on a part of a surface of the sheet so as not to cause the coating thereon to come off.

Aspect F

According to aspect F, in any one of aspects A to C, when the folded part forming unit forms a folded part on the sheet, the sheet folding apparatus changes a moving amount of the pushing member from the retracted position to the pushing position depending on a thickness of the sheet. According to this, as described in the above embodiment, a guide member is moved by a necessary moving amount depending on the thickness of the sheet. Energy consumption can be reduced accordingly.

Aspect G

According to aspect G, in any one of aspects A to C, when the folded part forming unit forms a folded part on the sheet, the sheet folding apparatus changes a moving amount of the pushing member from the retracted position to the pushing position depending on a type of the sheet. According to this, as described in the above embodiment, the guide member is moved by a necessary moving amount depending on the paper type of the sheet. Energy consumption can be reduced accordingly.

Aspect H

Aspect H provides an image forming apparatus such as the image forming apparatus 2 that includes an image forming unit such as the image forming unit 110 that forms an image on a sheet, and a sheet folding unit such as the folding processing apparatus 1 that is provided in an apparatus body of the image forming apparatus and performs folding processing on the sheet. As the sheet folding unit, the sheet folding apparatus according to any one of aspects A to G is used. This can achieve, as described in the above embodiment, good folding processing on a sheet on which an image is formed.

Aspect I

Aspect I provides an image forming system that includes an image forming apparatus such as the image forming apparatus 2 that forms an image on a sheet, and a sheet folding apparatus such as the folding processing apparatus 1 that is provided separately from the image forming apparatus and that performs folding processing on a sheet on which an image is formed. As the sheet folding apparatus, the sheet folding apparatus according to any one of aspects A to G is used. This can achieve, as described in the above embodiment, good folding processing on a sheet on which an image is formed.

According to the embodiment, when the folded part forming unit forms a folded part on a sheet, the pushing member is used to push a turned-back portion of the sheet toward the folded part forming unit. When the folded part forming unit does not form a folded part on a sheet, the pushing member is used to change the course of the sheet. That is, when the sheet is conveyed in the first conveying path from the first sheet conveying unit toward the second sheet conveying unit, the pushing member changes the direction of the leading end of the sheet into a direction toward the second conveying path. The single pushing member can perform two functions: of guiding a turned-back portion of a sheet toward the folded part forming unit; and of changing the course of the sheet. Compared with a case in which separate members are provided to carry out these functions, the sheet folding apparatus according to the embodiment can reduce the number of parts and additional installation space for the separate members, thereby reducing the size of the apparatus.

The embodiment provides an advantageous effect that a turned-back portion of a sheet can be guided toward a folded part forming unit, and the course of the sheet can be changed by changing the direction of the leading end of the sheet without increasing the size of a sheet folding apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding apparatus comprising:

a first conveying path in which a sheet is conveyed;

a first sheet conveying unit that holds the sheet conveyed in the first conveying path to apply conveying force to the sheet;

a second sheet conveying unit that is disposed downstream of the first sheet conveying unit in a sheet conveying direction, and holds the sheet to apply conveying force to the sheet;

a folded part forming unit that forms a folded part on a sheet by nipping a turned-back portion formed on a part of the sheet between the first sheet conveying unit and the second sheet conveying unit;

a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position, wherein the pushing member also serves as a changing unit that changes a direction of a leading end of the sheet that is conveyed in the first conveying path from the first sheet conveying unit toward the second sheet conveying unit into a direction toward the second conveying path, and wherein, when the folded part forming unit forms a folded part on the sheet, the sheet folding apparatus determines whether to move the pushing member from the retracted position to the pushing position depending on a type of the sheet.

2. The sheet folding apparatus according to claim 1, wherein a turned-back portion is formed on a part of the sheet between the first sheet conveying unit and the second sheet conveying unit by holding a part of the sheet by the first sheet conveying unit, and by applying conveying force to the sheet by the second sheet conveying unit to reverse the sheet upstream in the sheet conveying direction, and a folded part is formed on the sheet by moving the pushing member from the retracted position to the pushing position to push the turned-back portion to cause the folded part forming unit to nip the turned-back portion.

3. The sheet folding apparatus according to claim 1, wherein a leading end of the sheet conveyed from the first conveying unit is guided from the first conveying path to the second conveying path along a guide surface of the pushing member positioned in the pushing position.

4. The sheet folding apparatus according to claim 1, wherein, when the folded part forming unit forms a folded part on the sheet, the sheet folding apparatus determines whether to move the pushing member from the retracted position to the pushing position depending on a thickness of the sheet.

5. The sheet folding apparatus according to claim 1, wherein, when the folded part forming unit forms a folded part on the sheet, the sheet folding apparatus changes a moving amount of the pushing member from the retracted position to the pushing position depending on a thickness of the sheet.

6. The sheet folding apparatus according to claim 1, wherein, when the folded part forming unit forms a folded part on the sheet, the sheet folding apparatus changes a moving amount of the pushing member from the retracted position to the pushing position depending on a type of the sheet.

7. An image forming apparatus comprising:

an image forming unit that forms an image on a sheet; and a sheet folding unit that is provided in an apparatus body of the image forming apparatus and that performs folding processing on a sheet, wherein the sheet folding unit includes:

a first conveying path in which a sheet is conveyed;

a first sheet conveying unit that holds the sheet conveyed in the first conveying path to apply conveying force to the sheet;

a second sheet conveying unit that is disposed downstream of the first sheet conveying unit in a sheet conveying direction, and holds the sheet to apply conveying force to the sheet;

a folded part forming unit that forms a folded part on a sheet by nipping a turned-back portion formed on a part of the sheet between the first sheet conveying unit and the second sheet conveying unit;

a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position, wherein the pushing member also serves as a changing unit that changes a direction of a leading end of the sheet that is conveyed in the first conveying path from the first sheet conveying unit toward the second sheet conveying unit into a direction toward the second conveying path, and wherein, when the folded part forming unit forms a folded part on the sheet, the sheet folding apparatus determines whether to move the pushing member from the retracted position to the pushing position depending on a type of the sheet.

8. An image forming system comprising:

an image forming apparatus that forms an image on a sheet; and a sheet folding apparatus that is provided separately from the image forming apparatus and that performs folding processing on a sheet on which an image is formed by the image forming apparatus, wherein the sheet folding apparatus includes:

a first conveying path in which a sheet is conveyed;

a first sheet conveying unit that holds the sheet conveyed in the first conveying path to apply conveying force to the sheet;

a second sheet conveying unit that is disposed downstream of the first sheet conveying unit in a sheet conveying direction, and holds the sheet to apply conveying force to the sheet;

a folded part forming unit that forms a folded part on a sheet by nipping a turned-back portion formed on a part of the sheet between the first sheet conveying unit and the second sheet conveying unit;

a second conveying path that bifurcates from the first conveying path and in which a sheet on which a folded part is formed by the folded part forming unit is conveyed; and a pushing member that is movable between a pushing position at which the pushing member pushes the turned-back portion toward the folded part forming unit and a retracted position at which the pushing member is retracted from the pushing position, wherein the pushing member also serves as a changing unit that changes a direction of a leading end of the sheet that is conveyed in the first conveying path from the first sheet conveying unit toward the second sheet conveying unit into a direction toward the second conveying path, and wherein, when the folded part forming unit forms a folded part on the sheet, the sheet folding apparatus determines whether to move the pushing member from the retracted position to the pushing position depending on a type of the sheet.

* * * * *